US006721532B2

(12) United States Patent
Kosugi et al.

(10) Patent No.: US 6,721,532 B2
(45) Date of Patent: Apr. 13, 2004

(54) FIXING DEVICE CAPABLE OF CHANGING SMOOTHNESS OF SURFACE OF TONER OF FIXED TONER IMAGE ON SHEET AND IMAGE FORMING APPARATUS USING SAID FIXING DEVICE

(75) Inventors: Hideki Kosugi, Yokohama (JP); Katsuhiro Echigo, Asaka (JP)

(73) Assignee: Ricoh Company, Ltd., Tokyo (JP)

( * ) Notice: Subject to any disclaimer, the term of this patent is extended or adjusted under 35 U.S.C. 154(b) by 26 days.

(21) Appl. No.: 10/059,366

(22) Filed: Jan. 31, 2002

(65) Prior Publication Data

US 2002/0102118 A1 Aug. 1, 2002

(30) Foreign Application Priority Data

Jan. 31, 2001 (JP) ..... 2001-023163
Jan. 8, 2002 (JP) ..... 2002-001211

(51) Int. Cl.[7] ..... G03G 15/20
(52) U.S. Cl. ..... 399/341; 219/216
(58) Field of Search ..... 399/67, 68, 320, 399/328, 329, 341, 322; 219/216, 388, 469

(56) References Cited

U.S. PATENT DOCUMENTS

| | | | | | |
|---|---|---|---|---|---|
| 4,908,669 | A | * | 3/1990 | Yamamoto | 399/335 |
| 4,985,733 | A | | 1/1991 | Kurotori et al. | 399/156 |
| 4,987,457 | A | | 1/1991 | Mochizuki et al. | 399/331 |
| 5,196,895 | A | * | 3/1993 | Setoriyama et al. | 399/328 |
| 5,250,998 | A | * | 10/1993 | Ueda et al. | 399/329 |
| 5,493,365 | A | | 2/1996 | Matsui et al. | 399/1 |
| 5,592,275 | A | | 1/1997 | Echigo et al. | 399/325 |
| 5,678,161 | A | | 10/1997 | Kurotaka et al. | 399/400 |
| 5,708,949 | A | | 1/1998 | Kasahara et al. | 399/330 |
| 5,805,969 | A | * | 9/1998 | Elsermans et al. | 399/341 |
| 5,873,020 | A | * | 2/1999 | Matsuura et al. | 399/329 |
| 5,887,234 | A | * | 3/1999 | Aslam et al. | 399/322 |
| 5,923,930 | A | | 7/1999 | Tsukamoto et al. | 399/237 |
| 5,927,189 | A | * | 7/1999 | Jones et al. | 399/329 X |
| 6,055,390 | A | | 4/2000 | Kurotaka et al. | 399/69 |
| 6,078,766 | A | | 6/2000 | Kurotaka | 399/165 |
| 6,088,558 | A | | 7/2000 | Yamada et al. | 399/165 |
| 6,108,906 | A | | 8/2000 | Fujita et al. | 29/895.211 |
| 6,115,576 | A | | 9/2000 | Nakano et al. | 399/302 |
| 6,122,479 | A | | 9/2000 | Fujita et al. | 399/333 |
| 6,198,888 | B1 | | 3/2001 | Kurotaka et al. | 399/69 |
| 6,243,559 | B1 | | 6/2001 | Kurotaka et al. | 399/329 |
| 6,262,787 | B1 | | 7/2001 | Kamoi et al. | 349/96 |
| 6,272,310 | B1 | * | 8/2001 | Blair et al. | 399/341 |
| 6,295,435 | B1 | | 9/2001 | Shinohara et al. | 399/301 |
| 6,347,212 | B1 | | 2/2002 | Kosugi et al. | 399/348 |
| 6,366,751 | B1 | | 4/2002 | Shakuto et al. | 399/159 |

FOREIGN PATENT DOCUMENTS

| | | |
|---|---|---|
| JP | 63-300254 | 12/1988 |
| JP | 4-204669 | 7/1992 |
| JP | 5-333643 | 12/1993 |
| JP | 7-311505 | 11/1995 |
| JP | 9-265243 | 10/1997 |
| JP | 10-123795 | 5/1998 |
| JP | 11-024463 | 1/1999 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A fixing device that fixes an unfixed toner image onto a moving sheet, includes a first fixing unit that makes toner of the unfixed toner image penetrate into the sheet by heat and pressure so as to be fixed onto the sheet as a fixed toner image, and a second fixing unit arranged downstream of the first fixing unit in a sheet moving direction to contact and press the fixed toner image on the sheet to change smoothness of a surface of the toner of the fixed toner image on the sheet. The second fixing unit is arranged at a position where a temperature of the toner of the fixed toner image on the sheet is greater than a glass transition temperature.

55 Claims, 16 Drawing Sheets

FIXING DEVICE CAPABLE OF CHANGING SMOOTHNESS OF SURFACE OF TONER OF FIXED TONER IMAGE ON SHEET AND IMAGE FORMING APPARATUS USING SAID FIXING DEVICE

BACKGROUND OF THE INVENTION

1. Field of the Invention

The present invention relates to a fixing device for an image forming apparatus, and more particularly to the fixing device that provides desired image glossiness according to types of images.

2. Discussion of the Background

In an image forming apparatus, such as a copying machine, a facsimile machine, and a printer, a printed (copied) sheet is obtained by fixing an unfixed image onto a sheet as a recording material by heat and pressure in a fixing device.

The fixing device may employ any one of fixing methods such as "heating roller fixing method", "radiant/flash fixing method", and "oven fixing method". Specifically, in the heating roller fixing method, a sheet carrying an unfixed image is conveyed while being sandwiched between a pair of rollers including a heating roller, and the unfixed image is fixed onto the sheet by heat of the heating roller. In the radiant/flash fixing method, a fixing device includes an infrared/Xenon lamp as a heat source, and an unfixed image is fixed onto a sheet by radiant heat. In the oven fixing method, heating elements are arranged in the vicinity of both sides of a sheet, and an unfixed image is fixed onto the sheet by convected heat.

In the above-described fixing methods, the heating roller fixing method has been often employed because of advantages such as high thermal efficiency, high printing speed, high efficiency of heat transfer, and stabilized fixing efficiency. Further, a construction of an image forming apparatus including a fixing device using the heating roller fixing method may be simple, because the fixing device may also serve as a sheet conveying device.

In the heating roller fixing method, when toner on a sheet is changed from a solid to liquid state by heat and pressure, the toner is changed from a partly fused and coalescent condition to a fluid and spread condition, and is finally in a penetrating condition on the sheet. As a result, particulate toner of an image, which has been likely to be removed from a sheet, is fused and fixed onto the sheet.

When a toner image is fixed onto a sheet, fixing efficiency depends on the conditions such as temperature, heating time, and contact pressure. Therefore, respective conditions are needed to be set according to types of images.

In a case of multi-color image forming apparatus that forms multi-color images, image glossiness may be changed according to desired types of images. For example, when compared to photographic image and character image, glossiness of the photographic image, which depends on an amount of reflected light relative to that of incident light, is desired to be enhanced because of demand for high quality image.

As a background method of obtaining image glossiness according to types of images, Japanese Laid-open Patent Publications No. 63-300254 and No. 4-204669 respectively describe image forming apparatuses in which the glossiness of a black character image is decreased by increasing the viscosity and coefficient of elasticity of black toner more than those of other color toner.

Further, Japanese Laid-open Patent Publications No. 10-123795, No. 11-24463, and No. 5-333643 respectively describe image forming apparatuses in which the glossiness of a multi-color image is increased by changing the above-described temperature and contact time.

In the case of the background method of controlling the glossiness of a black character image, even though such the method is applied to a multi-color image, desired image glossiness may not be obtained.

In the case of the background method of controlling the glossiness of a multi-color image, desired glossiness of the multi-color image may be selectable, but the following concerns may be raised.

First, when temperature is switched between a multi-color mode and a single-color mode, because temperature may not be adjusted quickly, time for forming images may be increased. Further, in the case of low temperature, so-called cold offset condition (i.e., a part of toner image is adhered to a fixing member of a fixing device) and insufficient coloring may be likely to occur. In the case of high temperature, so-called hot offset condition (i.e., a part of toner image is adhered to a fixing member of a fixing device) winding of a sheet around a roller may occur. Accordingly, a range of switches of temperature results is narrowed. If the temperature is switched within a range in which the above-described defective conditions are avoided, desired image glossiness may not be obtained.

Second, when linear velocity of a fixing member is changed, it takes time for a sheet to be conveyed depending on the linear velocity. As a result, productivity at the time of image formation may be decreased.

Third, when changing pressure force of a fixing member, it may affect a sheet conveyance depending on flexural rigidity of a sheet. Particularly, when a thin sheet is used, wrinkles on the thin sheet and sheet jam may occur.

Another method of controlling image glossiness, which addresses the above-described concerns, is proposed. Specifically, a fixing device includes first and second fixing units respectively having pairs of heating and pressure members along a sheet conveying path. In such a fixing device, image glossiness is changed by making the surface roughness of one of the heating and pressure members of the second fixing unit which contacts a toner image on a sheet different from that of one of the heating and pressure members of the first fixing unit which contacts the toner image on the sheet.

In the above-described fixing device, control of temperature of toner of a toner image on a sheet is required when the surface of the toner of the toner image on the sheet is pressed by the pressure member of the second fixing unit arranged at a position away from the first fixing unit. Because a construction for controlling temperature and a heating construction are necessary for the second fixing unit in addition to the first fixing unit, a number of construction parts may be increased, thereby increasing the cost of an apparatus.

SUMMARY OF THE INVENTION

According to one aspect of the present invention, a fixing device that fixes an unfixed toner image onto a moving sheet, includes a first fixing unit configured to make toner of the unfixed toner image penetrate into the sheet by heat and pressure so as to be fixed onto the sheet as a fixed toner image, and a second fixing unit arranged downstream of the first fixing unit in a sheet moving direction and configured to contact and press the fixed toner image on the sheet to change smoothness of a surface of the toner of the fixed toner image on the sheet. The second fixing unit is arranged at a position where a temperature of the toner of the fixed toner image on the sheet is greater than a glass transition temperature.

According to another aspect of the present invention, a fixing device that fixes an unfixed toner image onto a moving sheet, includes a first fixing unit configured to make toner of the unfixed toner image penetrate into the sheet by heat and pressure so as to be fixed onto the sheet as a fixed toner image, a second fixing unit arranged downstream of the first fixing unit in a sheet moving direction and configured to contact and press the fixed toner image on the sheet to change smoothness of a surface of the toner of the fixed toner image on the sheet, and a first movable belt provided to span the first and second fixing units along the sheet moving direction and configured to move along the sheet moving direction and to contact a surface of the toner of the fixed toner image on the sheet between the first and the second fixing units. The first belt includes a thermal storage property.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
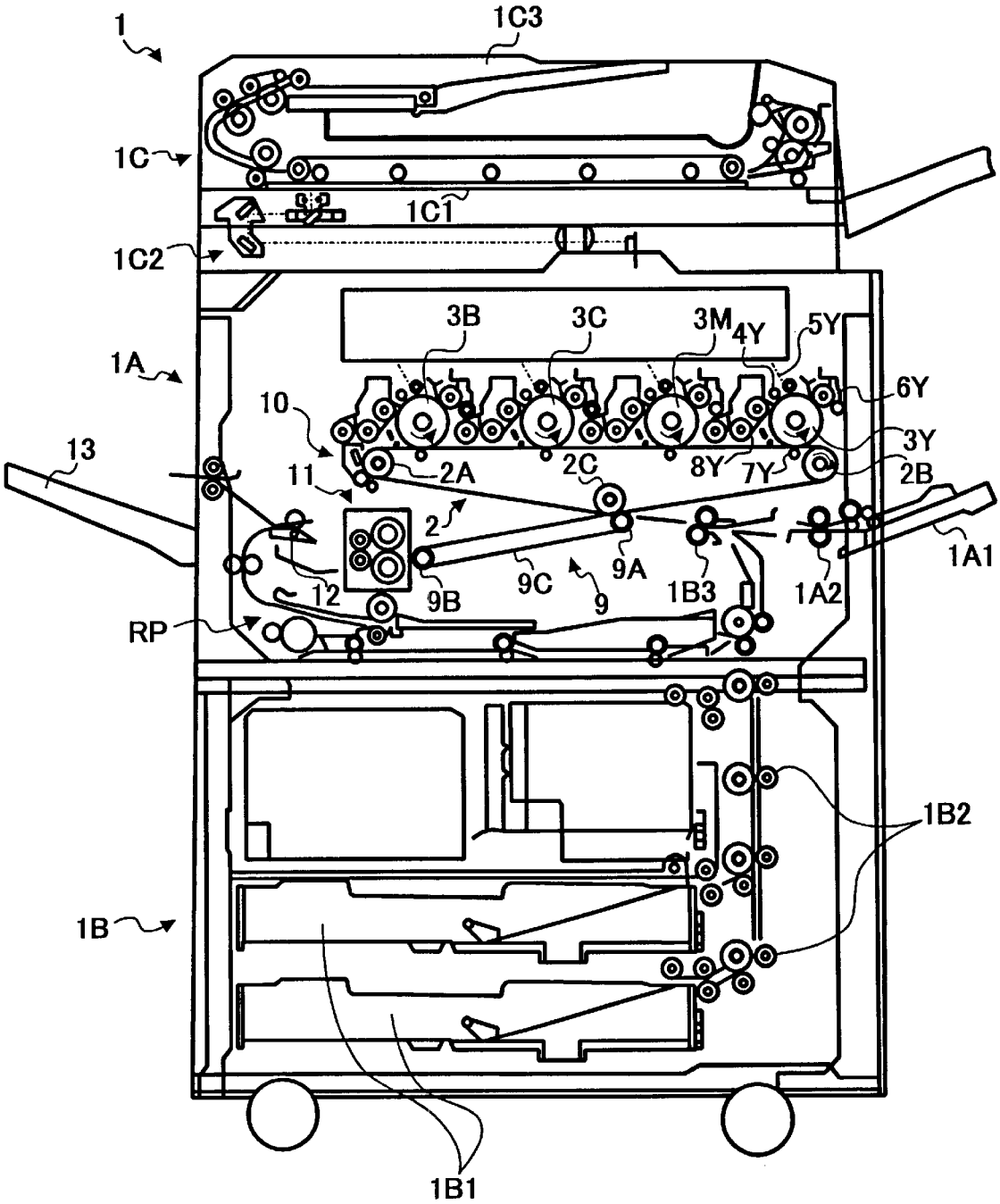
FIG. 1 is a schematic view of an image forming apparatus to which a fixing device according to an embodiment of the present invention is applied.

Preferred embodiments of the present invention are described in detail referring to the drawings, wherein like reference numerals designate identical or corresponding parts throughout the several views.

FIG. 1 is a schematic view of an image forming apparatus to which a fixing device according to an embodiment of the present invention is applied. In this embodiment, the image forming apparatus of FIG. 1 is a color printer that forms multi-color images on a recording material such as a sheet. The image forming apparatus according to the embodiment is not limited to the color printer but may be a color copier, a color facsimile machine, etc.

Referring to FIG. 1, a color printer 1 includes an image forming unit 1A at a substantially central part of the color printer 1 in a vertical direction, a sheet feeding unit 1B arranged below the image forming unit 1A, and an image scanning unit 1C having an original document setting table 1C1 arranged above the image forming unit 1A.

In the image forming unit 1A, an intermediate transfer belt 2 is extended in substantially a horizontal direction. Above the intermediate transfer belt 2, there is provided a construction for forming images whose colors are in a complementary relation to each of separated colors of images of an original document.

In the image forming unit 1A, photoreceptors 3Y, 3M, 3C, and 3B (hereinafter may be referred to as photoreceptors 3 as a whole) which bear images of color toner of yellow, magenta, cyan, and black, respectively, are arranged in a line along an extended surface of the intermediate transfer belt 2.

Each of the photoreceptors 3Y, 3M, 3C, and 3B is constructed of a drum that rotates in the same direction (e.g., in a counter-clockwise direction in FIG. 1). Arranged around the photoreceptors 3Y, 3M, 3C, and 3B are charging devices 4Y, 4M, 4C, and 4B (hereinafter may be referred to as charging devices 4 as a whole), image writing devices 5Y, 5M, 5C, and 5B (hereinafter may be referred to as image writing devices 5 as a whole), developing devices 6Y, 6M, 6C, and 6B (hereinafter may be referred to as developing devices 6 as a whole), primary transfer devices 7Y, 7M, 7C, and 7B (hereinafter may be referred to as primary transfer devices 7 as a whole), and cleaning devices 8Y, 8M, 8C, and 8B (hereinafter may be referred to as cleaning devices 8 as a whole), respectively. A primary transfer means transfers of each color toner image from the photoreceptors 3 to the intermediate transfer belt 2. In FIG. 1, for convenience's shake, only the above-described devices around the photoreceptor 3Y are identified by respective reference characters with "Y".

The intermediate transfer belt 2 is spanned around a plurality of rollers 2A, 2B, and 2C, and is constructed to move in the same moving direction as that of the photoreceptors 3 at positions where the intermediate transfer belt 2 opposes the photoreceptors 3. The roller 2C is arranged opposite to a secondary transfer device 9 via the intermediate transfer belt 2. A secondary transfer means a transfer of the four superimposed color toner images from the intermediate transfer belt 2 to a sheet. A reference numeral 10 in FIG. 1 indicates a cleaning device that removes residual color toner from the intermediate transfer belt 2.

The secondary transfer device 9 includes a transfer belt 9C spanned around a charging drive roller 9A and a driven roller 9B and is movable in the same direction as a moving direction of the intermediate transfer belt 2 at a secondary transfer position where the transfer belt 9C faces the intermediate transfer belt 2. A multi-color toner image or a single color toner image on the transfer belt 9C is transferred onto a sheet by charging the transfer belt 9C with the charging drive roller 9A.

A sheet is fed to the secondary transfer position from the sheet feeding unit 1B. The sheet feeding unit 1B includes a plurality of sheet feeding cassettes 1B1, a plurality of sheet conveying rollers 1B2 arranged along a sheet conveying path through which the sheet is conveyed from the sheet feeding cassettes 1B1, and a pair of registration rollers 1B3 situated before the secondary transfer position. The color printer 1 further includes a manual sheet feeding tray 1A1 on the right-hand side wall of the image forming unit 1A in FIG. 1 to feed different type of sheets from the sheets stored in the sheet feeding cassettes 1B1, toward the registration rollers 1B3 by a pair of sheet feeding rollers 1A2.

A sheet conveying path through which a sheet fed from the manual sheet feeding tray 1A1 is conveyed joins the sheet conveying path extending from the sheet feeding cassettes 1B1 toward the registration rollers 1B3. A sheet fed from either the sheet feeding cassettes 1B1 or the manual sheet feeding tray 1A1 is conveyed by the registration rollers 1B3 toward the secondary transfer position at an appropriate timing.

The image writing devices 5 emit a plurality of laser beams and form electrostatic latent images (hereinafter simply referred to as latent images) on each of the surfaces of the photoreceptors 3, which is uniformly charged by the charging devices 4, according to image information obtained by scanning original documents on the original document setting table 1C1 or output from a computer (not shown).

The original document scanning unit 1C includes a scanner 1C2 that scans original documents on the original document setting table 1C1, and an auto document feeder 1C3 on the original document setting table 1C1. The auto document feeder 1C3 automatically feeds original documents to be scanned successively. The auto document feeder 1C3 has a sheet reversing function for scanning front and rear surfaces of the original document.

The latent images formed on the photoreceptors 3 by the image writing devices 5 are developed with yellow, magenta, cyan, and black color toner by the developing devices 6 into each color toner image. The toner images for yellow, magenta, cyan, and black are subsequently transferred onto the surface of the intermediate transfer belt 2 with the leading edge of each color toner image aligned, and are superimposed thereon. Thereafter, the four superimposed color toner images are transferred to a sheet at one time by the secondary transfer device 9.

The sheet having the four superimposed color toner images is conveyed to a fixing device 11 to fix the four superimposed color toner images on the sheet. The details of the fixing device 11 will be described later.

The sheet having passed through the fixing device 11 is guided to a sheet conveying path toward a sheet discharging tray 13 or a sheet reversing path RP by a separation guide pick 12 arranged downstream of the fixing device 11 in the sheet conveying direction. The sheet guided to the sheet reversing path RP is reversed for receiving another image on the other side of the sheet, and is conveyed to the registration rollers 1B3 again.

In the case of single-color printing, a single color toner image formed on the surface of any one of the photoreceptors 3 is transferred to the intermediate transfer belt 2, and is then transferred onto a sheet.

The construction of the fixing device 11 will be described referring to FIGS. 2A and 2B (hereinafter may be referred to as FIG. 2 as a whole). The fixing device 11 according to the embodiment of the present invention includes a first fixing unit 11A and a second fixing unit 11B arranged along a moving direction of a sheet S carrying toner T of an unfixed toner image.

The first fixing unit 11A includes a fixing roller 11A1 and a pressure roller 11A2 which contact each other and rotate at substantially the same speed. The fixing roller 11A1 includes a heat source 11A3 such as a halogen heater and opposes the toner T on the sheet S. The fixing roller 11A1 includes an elastic layer covering a metal core. In addition, the surface layer on the elastic layer of the fixing roller 11A1 is formed from a toner releasing layer.

The pressure roller 11A2 opposes and contacts a surface of the sheet S opposite the surface of the sheet S contacting the toner T. The pressure roller 11A2 includes an elastic layer covering a metal core.

The fixing roller 11A1 and the pressure roller 11A2 form a nip part where the sheet S is sandwiched between the circumferential surfaces of the fixing roller 11A1 and the pressure roller 11A2. The toner T on the sheet S is changed from a partly fused and coalescent condition to a fluid and spread condition, and finally in a penetrating condition by heat and pressure in the nip part.

In the first fixing unit 11A, the fixing roller 11A1 and the pressure roller 11A2 contact each other at predetermined pressure. Further, the surface temperature of the fixing roller 11A1 is kept at a predetermined value set by the heat source 11A3. In this embodiment, the surface temperature of the fixing roller 11A1 is set to, for example, 170° C. such that the temperature of the toner T on the sheet S becomes greater than a glass transition temperature.

The second fixing unit 11B is arranged downstream of the first fixing unit 11A in a sheet moving direction. The second fixing unit 11B includes a pair of sheet conveying rollers 11B1 and 11B2 which contact and separate from each other via a sheet conveying path. The sheet conveying roller 11B1 opposes the toner T on the sheet S, and the sheet conveying roller 11B2 opposes the surface of the sheet S opposite the surface of the sheet S contacting the toner T.

Unlike the first fixing unit 11A, the second fixing unit 11B does not include a heat source. The second fixing unit 11B is configured such that the sheet conveying rollers 11B1 and 11B2 contact and press the toner image fixed onto the sheet S in the first fixing unit 11A to change smoothness of the surface of the toner T of the fixed toner image on the sheet S.

Figure 2A:
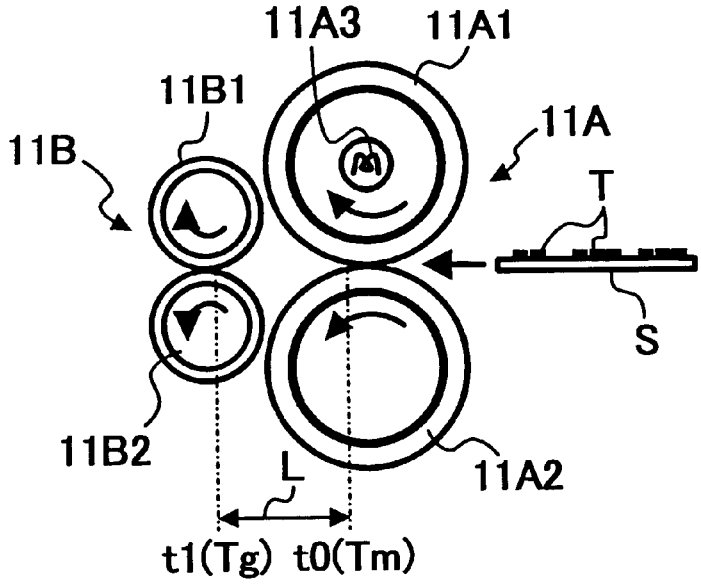
FIGS. 2A and 2B are schematic views of a construction of the fixing device of FIG. 1 according to an embodiment of the present invention.
Figure 2B:
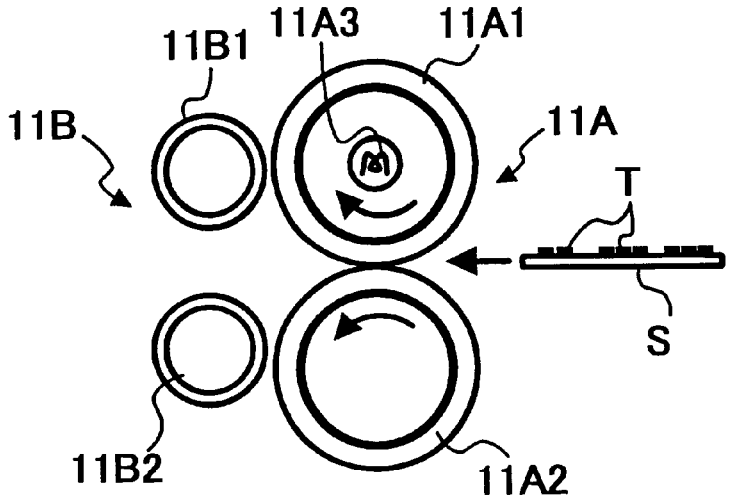

Specifically, when changing the smoothness of the surface of the toner T of the fixed toner image on the sheet S, the pair of sheet conveying rollers 11B1 and 11B2 contact each other via the fixed toner image on the sheet S to change the smoothness of the surface of the toner T of the fixed toner image on the sheet S as illustrated in FIG. 2A, and when not changing the smoothness of the surface of the toner T of the fixed toner image on the sheet S, the pair of sheet conveying rollers 11B1 and 11B2 separate from each other so that the toner T of the fixed toner image on the sheet S does not contact the sheet conveying rollers 11B1 and 11B2 as illustrated in FIG. 2B.

Referring to FIG. 2A, the second fixing unit 11B is arranged at a position where a surface temperature (T1) of the toner T of the fixed toner image on the sheet S at a nip part between the sheet conveying rollers 11B1 and 11B2 is greater than a glass transition temperature (Tg). By arranging the second fixing unit 11B at the above-described position, even though the temperature of the toner T of the fixed toner image on the sheet S when the sheet S leaves the first fixing unit 11A decreases, the temperature of the toner T of the fixed toner image on the sheet S is kept greater than the glass transition temperature when the sheet S arrives the second fixing unit 11B.

The inventors performed experiments to find a period of time when the temperature of the toner T of the fixed toner image on the sheet S when the sheet S leaves the first fixing unit 11A changes to the glass transition temperature or less. Based on the experiments, it was found that the above-described period of time is about one second. Taking consideration of the above-described period of time and a moving speed of the sheet S between the first fixing unit 11A and the second fixing unit 11B, it is preferable to arrange the second fixing unit 11B at a position where the surface temperature (T1) of the toner T of the fixed toner image on the sheet S at the nip part between the sheet conveying rollers 11B1 and 11B2 is greater than the glass transition temperature (Tg).

The heat physical properties of toner used in this embodiment are as follows:

Glass transition temperature (Tg): 66° C.

Temperature in which toner in a liquid state flows out: 100° C.

Temperature in which about half amount of toner flows out: 123° C.

In the above-described construction of the fixing device 11 of FIG. 2A according to the embodiment of the present invention, the toner image fixed onto the sheet S in the first fixing unit 11A is pressed again in the second fixing unit 11B by contacting the sheet conveying rollers 11B1 and 11B2 each other. When the sheet S arrives the nip part between the sheet conveying rollers 11B1 and 11B2, the temperature of the toner T of the fixed toner image on the sheet S is greater than the glass transition temperature, and thereby the toner T of the fixed toner image on the sheet S is kept in a low viscoelastic condition. Therefore, when the fixed toner image on the sheet S is pressed again in the second fixing unit 11B, the smoothness of the surface of the toner T of the fixed toner image on the sheet S increases, thereby enhancing glossiness of toner image. As described above, in this embodiment, when increasing the smoothness of the surface of the toner T of the fixed toner image on the sheet S, the sheet conveying rollers 11B1 and 11B2 contact each other via the fixed toner image on the sheet S.

Through experiments by the inventors, the following results were obtained with regard to glossiness of toner image. Specifically, glossiness of the fixed toner image on the sheet S when the sheet S leaves the first fixing unit 11A is 19.8%. Further, glossiness of the fixed toner image on the sheet S when the sheet S leaves the second fixing unit 11B is 35.7%. As a result, the glossiness of the fixed toner image increases about double. In the experiments, weight average diameter of the toner T was set to be in a range of 4 $\mu$m to 15 $\mu$m in consideration of avoiding the decrease of resolution of the toner image.

FIG. 2B illustrates the fixing device 11 when not changing the smoothness of the surface of the toner T of the fixed toner image on the sheet S. In this case, the sheet conveying rollers 11B1 and 11B2 of the second fixing unit 11B separate from each other so that the toner T of the fixed toner image on the sheet S does not contact the sheet conveying rollers 11B1 and 11B2. Consequently, the smoothness of the surface of the toner T of the fixed toner image on the sheet S obtained by heat and pressure in the first fixing unit 11A is reflected in glossiness of toner image.

According to the embodiment of the present invention, when changing the smoothness of the surface of the toner T of the fixed toner image on the sheet S, an operation of contacting the sheet conveying rollers 11B1 and 11B2 in the second fixing unit 11B is necessary, but switch of temperature or change of sheet moving speed between the first fixing unit 11A and the second fixing unit 11B is not necessary. As a result, the construction of the color printer 1 may be simplified.

According to the embodiment of the present invention, the following fixing conditions are set between the first fixing unit 11A and the second fixing unit 11B.

<First Condition>

Pressure forces (MPa) on the sheet S in the first fixing unit 11A and the second fixing unit 11B satisfy a following condition:

$$P2 \geqq P1(MPa)$$

where P1 is a pressure force on the sheet S in the first fixing unit 11A, and P2 is a pressure force on the sheet S in the second fixing unit 11B.

<Second Condition>

Surface roughness (Rz) of the fixing roller 11A1 that contacts the toner T in the first fixing unit 11A and of the sheet conveying roller 11B1 that contacts the toner T in the second fixing unit 11B satisfies a following condition:

$$R2 \leqq R1(\mu m)$$

where R1 is surface roughness of the fixing roller 11A1, and R2 is surface roughness of the sheet conveying roller 11B1.

By satisfying the first and second conditions, the smoothness of the surface of the toner T of the toner image fixed onto the sheet S in the first fixing unit 11A is effectively increased in the second fixing unit 11B.

<Third Condition>

Surface energy (mN/m) of the fixing roller 11A1 that contacts the toner T in the first fixing unit 11A and of the sheet conveying roller 11B1 that contacts the toner T in the second fixing unit 11B satisfies a following condition:

$$E2 \leqq E1(mN/m)$$

where E1 is surface energy of the fixing roller 11A1, and E2 is surface energy of the sheet conveying roller 11B1.

The third condition considers that wetting in which the interface between solid (roller) and liquid (fused toner) replaces the interface between solid (roller) and air depends on the surface tension of the roller. The wetting depends on relative interfacial tension between the liquid and solid. The surface tension of the roller changes according to the surface energy, and the surface tension influences the tendency of adhering of toner. When the surface tension of the liquid is smaller than the critical surface tension of the solid, a wetting condition is obtained. By satisfying the third condition, occurrence of toner offset in which a part of a toner image adheres to the sheet conveying roller 11B1 in the second fixing unit 11B may be obviated.

With regard to a relationship between surface energy and surface roughness, the following results were obtained through experiments by the inventors. The surface roughness may be used as one of the parameters of setting the surface energy.

It was found that when the surface roughness (Rz) is 1 $\mu$m, the surface energy is about 21 mN/m, and when the surface roughness (Rz) is 5 $\mu$m, the surface energy is about 27 mN/m.

<Fourth Condition>

Referring to FIG. 2A, a distance between the first fixing unit 11A and the second fixing unit 11B satisfies a following condition:

$$L<V(T0-T1)$$

where T0 is a temperature of the toner T of the fixed toner image on the sheet S when the sheet S leaves the first fixing unit 11A, T1 is a temperature of the toner T of the fixed toner image on the sheet S when the sheet S arrives the second fixing unit 11B, and V (mm/s) is a moving speed of the sheet S between the first fixing unit 11A and the second fixing unit 11B, and wherein the temperature (T1) equals a glass transition temperature or more, and wherein (T0−T1) represents a period of time when T0 changes to T1.

By satisfying the fourth condition, the fixed toner image on the sheet S may be pressed again in the second fixing unit 11B while the toner T of the fixed toner image on the sheet S is kept in a low viscoelastic condition.

Figure 3A:
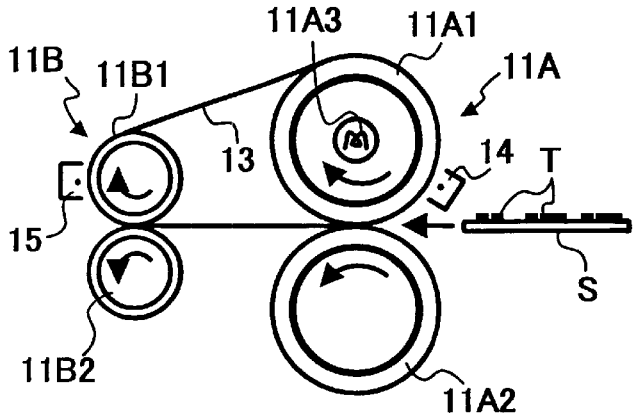
FIGS. 3A and 3B are schematic views of a construction of a fixing device according to another embodiment of the present invention.
Figure 3B:
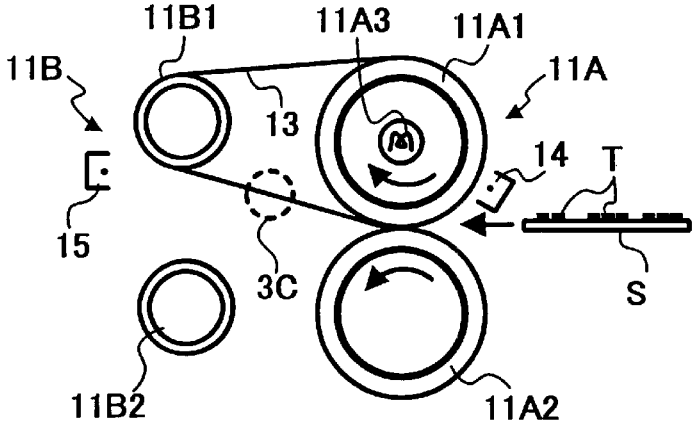

Next, a fixing device according to another embodiment of the present invention will be described referring to FIGS. 3A through 3C (hereinafter may be referred to as FIG. 3 as a whole). Members having substantially the same functions as those used in the fixing device of FIG. 2 will be designated with the same reference numerals. The characteristic of the fixing device according to the another embodiment is that the temperature of the toner T of the fixed toner image on the sheet S moving from the first fixing unit 11A to the second fixing unit 11B is prevented from decreasing.

In the fixing device of FIG. 3, a belt 13 having a thermal storage property is provided to span the first fixing unit 11A and the second fixing unit 11B along the sheet moving direction. Specifically, the belt 13 spans the fixing roller 11A1 of the first fixing unit 11A and the sheet conveying roller 11B1 of the second fixing unit 11B both of which are arranged on a side where the fixing roller 11A1 and the sheet conveying roller 11B1 oppose the toner T carried on the sheet S.

Figure 3C:
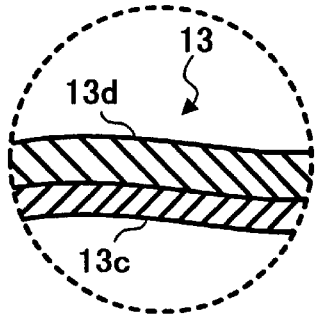
FIG. 3C is an enlarged view of a belt of the fixing device of FIG. 3B.

The belt 13 is an endless belt including a base layer **13*d* and a surface layer having a toner releasing property (i.e., a toner releasing layer 13*c*) as illustrated in FIG. 3C. The reason why the surface layer of the belt 13 has a toner releasing property is as follows. The sheet S moving together with the belt 13 is away from the belt 13 by use of the curvature of the sheet conveying roller 11B1 after the sheet S passes through the nip part between the sheet conveying rollers 11B1 and 11B2 of the second fixing unit 11B. With the provision of the toner releasing layer 13*c* on the surface of the belt 13, the toner T is prevented from being removed from the sheet S when the sheet S is away from the belt 13. In other words, occurrence of toner offset is avoided. Owing to the toner releasing layer 13*c* of the belt 13, the smoothness of the surface of the toner T of the fixed toner image on the sheet S increased in the second fixing unit 11B** may be maintained, and thereby desired glossiness of toner image may be obtained.

In order for the toner T to be spread on the sheet S without adhering to the belt 13, the toner T is needed to get more wet relative to the sheet S than relative to the surface layer of the belt 13. As described earlier, wetting depends on relative interfacial tension between liquid and solid. When the surface tension of the liquid is smaller than the critical surface tension of the solid, a wetting condition is obtained.

The surface tension of toner in a temperature range in which toner is fixable onto a sheet was found to range from 20 mN/m to 30 mN/m based on experiments. In addition, as the surface tension of the sheet S is in a range of 40 mN/m to 50 mN/m, it is found that surface energy of the surface layer of the belt 13 is preferably 30 mN/m or less.

In this embodiment, the smoothness of the surface of the toner T of the fixed toner image on the sheet S depends on the smoothness of the surface of the belt 13. Because the smoothness of the surface of the toner T of the fixed toner image on the sheet S is increased in the second fixing unit 11B based on that of the surface of the toner T of the toner image fixed on the sheet S in the first fixing unit 11A, it is preferable that the smoothness of the surface of the belt 13 is set such that the smoothness of the surface of the toner T of the fixed toner image on the sheet S obtained in the first fixing unit 11A is maintained. Therefore, roughness of the surface of the belt 13 approximates or equals surface roughness of the toner T of the fixed toner image on the sheet S set in the first fixing unit 11A. For example, the roughness of the surface of the belt 13 is set to 1 $\mu$m or less. By setting the roughness of the surface of the belt 13 as described above, the smoothness of the surface of the toner T of the fixed toner image on the sheet S obtained in the first fixing unit 11A may be maintained until the sheet S arrives the second fixing unit 11B. Similarly as in the fixing device 11 illustrated in FIG. 2, the toner image fixed onto the sheet S in the first fixing unit 11A is pressed again in the second fixing unit 11B by contacting the sheet conveying rollers 11B1 and 11B2 each other via the belt 13. When the fixed toner image on the sheet S is pressed again in the second fixing unit 11B, the smoothness of the surface of the toner T of the fixed toner image on the sheet S increases, thereby enhancing glossiness of toner image.

The belt 13 includes the base layer **13*d* and the toner releasing layer 13*c* in the order from the side where the belt 13 opposes the fixing roller 11A1 and the sheet conveying roller 11B1. The base layer 13*d* of the belt 13 may be made of material having, for example, high heat resisting property, high durability, and high mechanical strength. Specifically, for example, the base layer 13*d* of the belt 13** is made of a metallic film such as nickel, aluminium, copper, and stainless films, or a polymeric resin film such as polyimide, polyaramide, polyamide-imide, polyester, polyetheretherketone (PEEK), polytetrafluoroethylene (PTFE) film.

The toner releasing layer 13*c* may be made of material having heat resisting property and small surface energy, for example, high polymer resin such as silicone resin and fluororesin, or rubber material such as silicone rubber and fluororubber.

Similarly as in the fixing device of FIG. 2, the second fixing unit 11B is configured such that the sheet conveying rollers 11B1 and 11B2 contact and press the toner image fixed onto the sheet S in the first fixing unit 11A via the belt 13 to increase smoothness of the surface of the toner T of the fixed toner image on the sheet S. When not changing the smoothness of the surface of the toner T of the fixed toner image on the sheet S, the sheet conveying rollers 11B1 and 11B2 separate from each other so that the fixed toner image on the sheet S is not pressed by the sheet conveying rollers 11B1 and 11B2 via the belt 13 as illustrated in FIG. 3B.

Because the belt 13 is provided on a side where the belt 13 contacts the toner T on the sheet S in the fixing device of FIG. 3, the sheet S carrying the toner T moves without being supported. Therefore, a construction for adsorbing the sheet S onto the belt 13 is provided in this embodiment. Specifically, the fixing device of FIG. 3 includes a charger 14 that charges the belt 13 so as to electrostatically adsorb the sheet S to the belt 13, and a discharging charger 15 that discharges the belt 13 after the belt 13 passes through the nip part between the sheet conveying rollers 11B1 and 11B2.

With the above-described construction of the fixing device of FIG. 3, heat of the fixing roller 11A1 in the first fixing unit 11A is transmitted to the belt 13. Because the belt 13 has a thermal storage property, heat transfer does not occur between the belt 13 and the sheet S. While the sheet S is conveyed from the first fixing unit 11A to the second fixing unit 11B, heat is prevented from being released from the sheet S. Further, because the toner T of the fixed toner image on the sheet S is kept in a low viscoelastic condition when the fixed toner image on the sheet S is conveyed to the nip part between the sheet conveying rollers 11B1 and 11B2, the surface of the toner T of the fixed toner image on the sheet S is likely to be smoothly leveled by the pressure by the sheet conveying rollers 11B1 and 11B2. Particularly, the drop of temperature of the toner T of the fixed toner image on the sheet S is suppressed between the first fixing unit 11A and the second fixing unit 11B, and thereby the smoothness of the surface of the toner T of the fixed toner image on the sheet S may be increased when the fixed toner image on the sheet S is pressed again in the second fixing unit 11B.

Figure 4A:
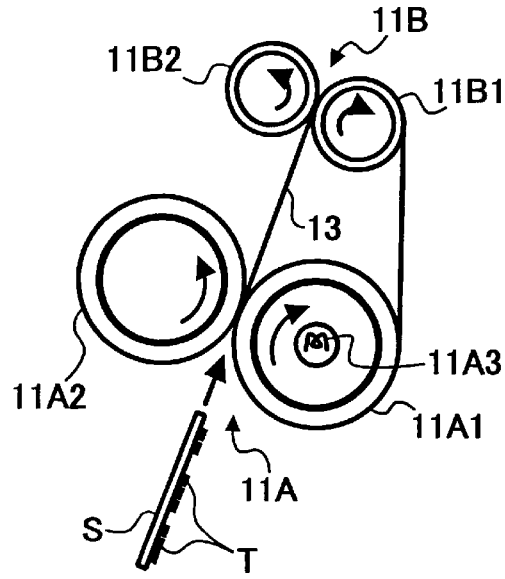
FIGS. 4A and 4B are schematic views of a construction of a fixing device of an alternative example of the fixing device of FIGS. 3A and 3B.
Figure 4B:
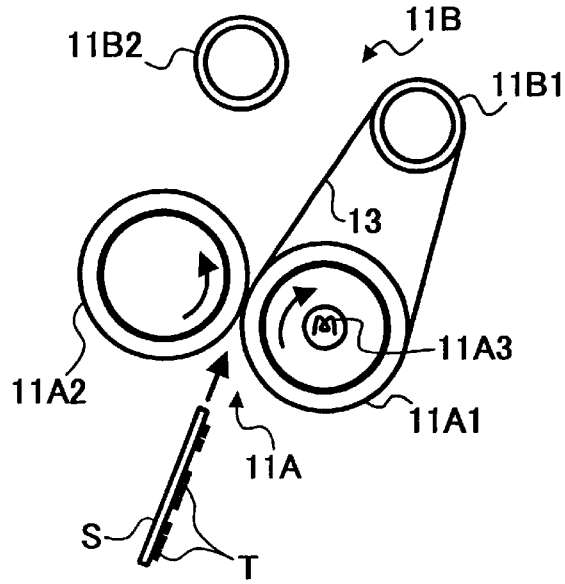

FIGS. 4A and 4B (hereinafter may be referred to as FIG. 4 as a whole) illustrate a fixing device of an alternative example of the fixing device of FIG. 3. In this alternative example, the belt 13 is slantly spanned around the fixing roller 11A1 and the sheet conveying roller 11B1 such that the surface of the sheet S contacting the toner T of the fixed toner image is directed downward. In the fixing device of this alternative example, the gravity of the sheet S is exerted on the belt 13, thereby obviating the necessity for the charges used in the fixing device of FIG. 3 to forcibly adsorb the sheet S to the belt 13.

Figure 5A:
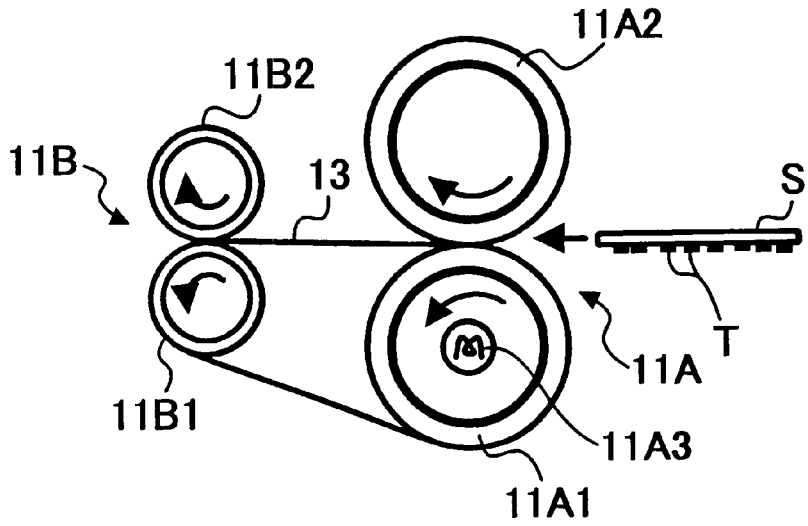
FIGS. 5A and 5B are schematic views of a construction of a fixing device of another alternative example of the fixing device of FIGS. 3A and 3B.
Figure 5B:
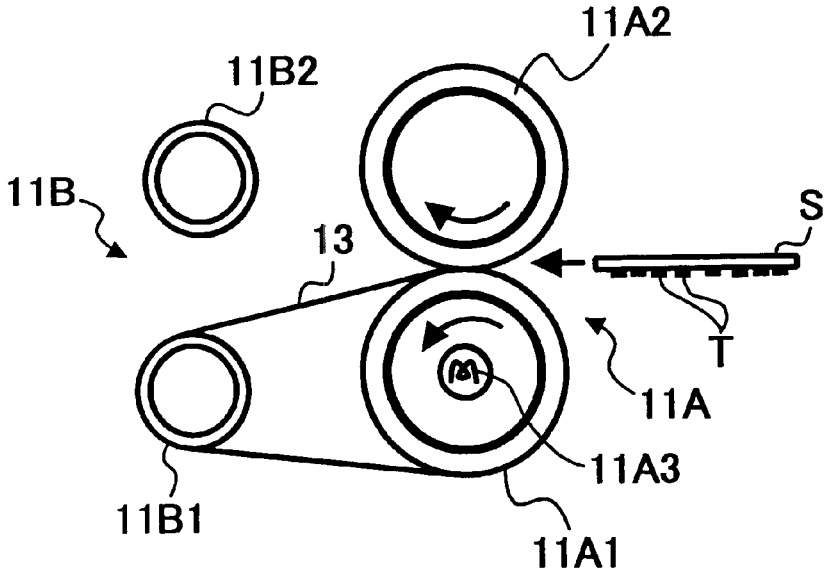

As another non-limiting alternative construction of the fixing device in which the sheet S is prevented from being removed from the belt 13 by directing the surface of the sheet S contacting the toner T downward, as illustrated in FIGS. 5A and 5B (hereinafter may be referred to as FIG. 5 as a whole), the fixing roller 11A1 and the pressure roller 11A2 of the first fixing unit 11A, the sheet conveying rollers 11B1 and 11B2 of the second fixing unit 11B, and the belt 13 may be inversely arranged as compared to the fixing device of FIG. 3. In the fixing device of FIG. 5, the surface of the sheet S contacting the toner T of the fixed toner image is directed downward.

Figure 6A:
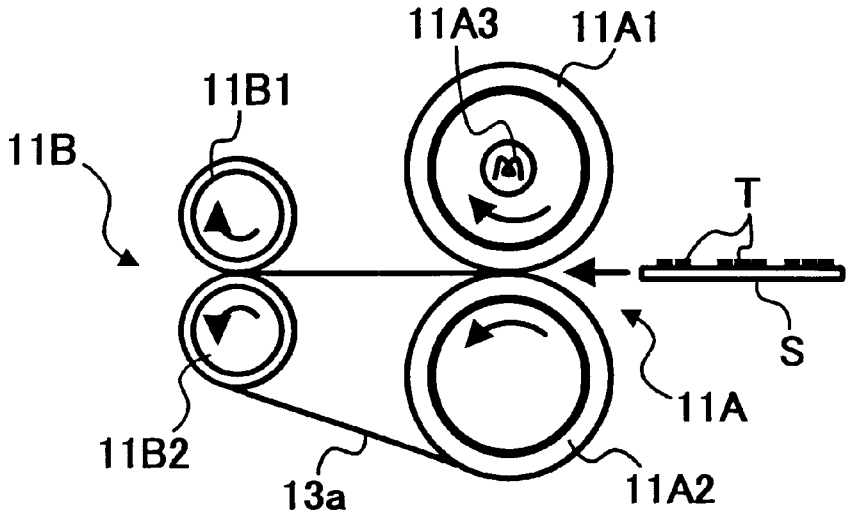
FIGS. 6A and 6B are schematic views of a construction of a fixing device of another alternative example of the fixing device of FIGS. 3A and 3B.
Figure 6B:
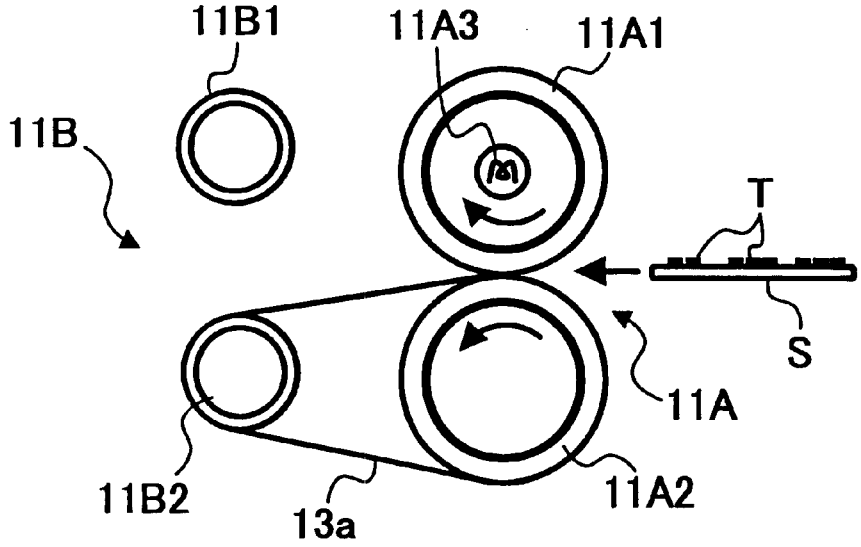

FIGS. 6A and 6B (hereinafter may be referred to as FIG. 6 as a whole) illustrate another alternative construction of the fixing device in which the belt 13 is arranged on a rear surface side of the sheet S (i.e., on a side of a surface of the sheet S opposite the surface of the sheet S contacting the toner T of the fixed toner image). In the construction of the fixing device of FIG. 6, the belt 13 is not in direct contact with the toner T. Therefore, the toner T on the sheet S is not rubbed against the belt 13, thereby avoiding image deterioration and change of smoothness of the surface of the toner T of the fixed toner image on the sheet S set in the first fixing unit 11A.

Figure 7A:
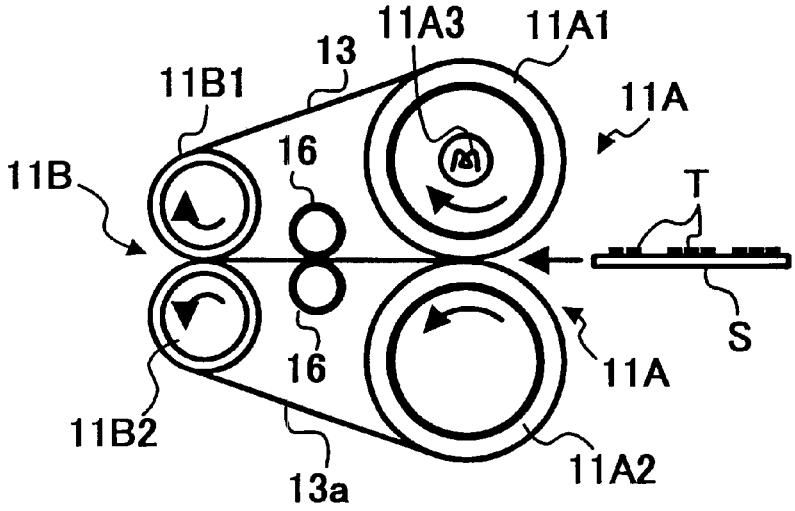
FIGS. 7A and 7B are schematic views of a construction of a fixing device according to another embodiment of the present invention.
Figure 7B:
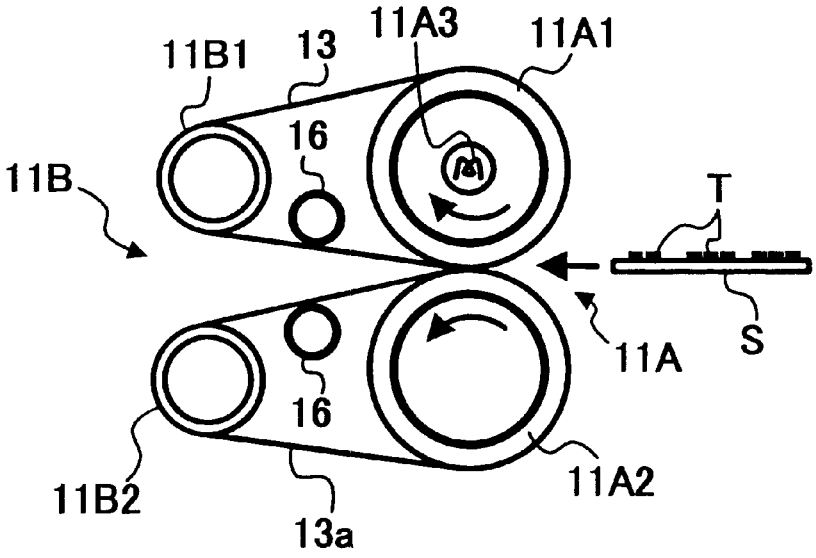

FIGS. 7A and 7B (hereinafter may be referred to as FIG. 7 as a whole) illustrate a fixing device according to another embodiment of the present invention. In the fixing device of FIG. 7, the belt 13 spans the fixing roller 11A1 and the sheet conveying roller 11B1, and a belt 13*a* spans the pressure roller 11A2 and the sheet conveying roller 11B2 such that the belts 13 and 13*a* oppose front and rear surface sides of the sheet S, respectively.

The belts 13 and 13*a* are made of substantially the same material and rotate in contact with each other between the first fixing unit 11A and the second fixing unit 11B. With this construction, the sheet S is conveyed from the first fixing unit 11A to the second fixing unit 11B while being sandwiched between the belts 13 and 13*a*. In this condition, there is no heat insulating layer of air between the surface of the sheet S contacting the toner T of the fixed toner image and the belt 13.

Further, between the first fixing unit 11A and the second fixing unit 11B, a back pressure member 16 that presses the belt 13 toward the surface of the sheet S contacting the toner T of the fixed toner image is provided on a rear surface side of the belt 13 opposing the surface of the sheet S contacting the toner T of the fixed toner image. However, as illustrated in FIG. 7, another back pressure member 16 may be provided on a rear surface side of the belt 13*a*.

Figure 8A:
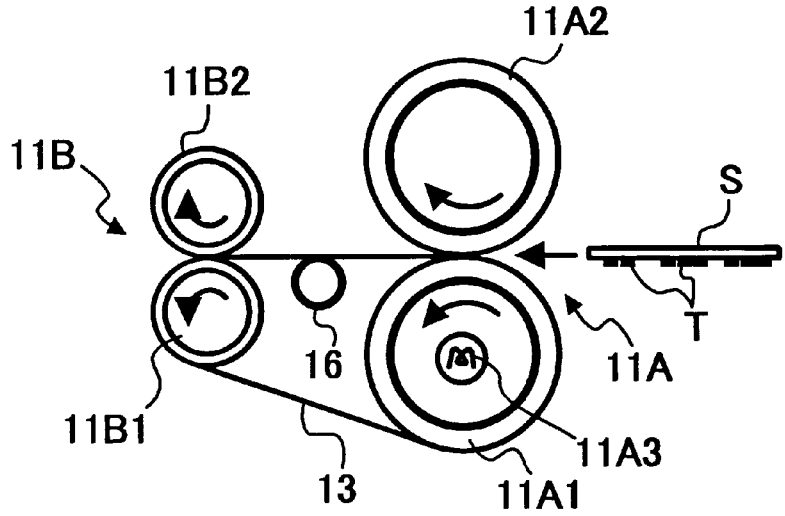
FIGS. 8A and 8B are schematic views of a construction of a fixing device of an alternative example of the fixing device of FIGS. 7A and 7B.
Figure 8B:
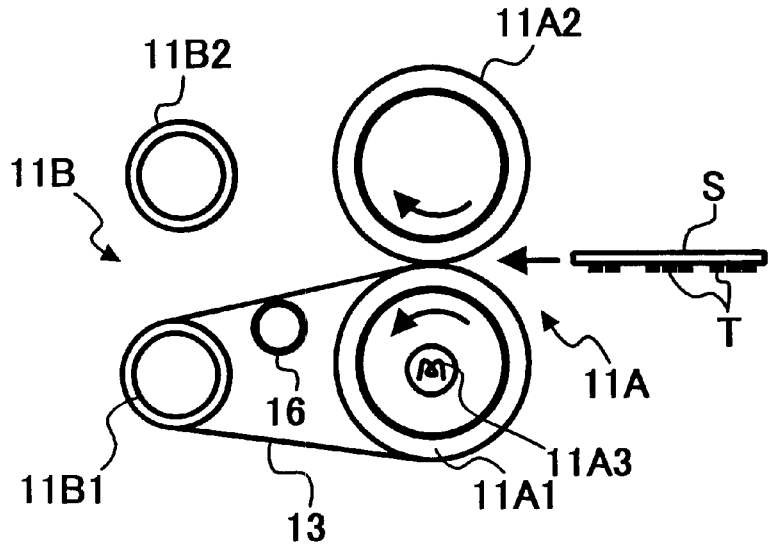

In the case of fixing device illustrated in FIGS. 8A and 8B (hereinafter may be referred to as FIG. 8 as a whole) in which a surface of the sheet S contacting the toner T of the fixed toner image faces downward and the belt 13 is arranged on a side where the belt 13 contacts the toner T of the fixed toner image on the sheet S and spans the fixing roller 11A1 and the sheet conveying roller 11B1, the back pressure member 16 may be provided at a rear surface side of the belt 13 between the first fixing unit 11A and the second fixing unit 11B. In this construction of the fixing device of FIG. 8, the back pressure member 16 serves to prevent the belt 13 from hanging between the first fixing unit 11A and the second fixing unit 11B, thereby keeping the sheet S and the belt 13 in contact condition and preventing the temperature of the toner T from dropping.

In the fixing devices illustrated in FIGS. 7 and 8, the belt 13 is pressed toward the surface of the sheet S contacting the toner T of the fixed toner image by the back pressure member 16, and thereby the belt 13, which serves as a heat insulating material for the sheet S, is brought in tight contact with the sheet S. As a result, the temperature of the toner T of the fixed toner image on the sheet S is effectively prevented from dropping. Further, because there is no heat insulating layer of air between the sheet S and the belt 13, transfer of heat is accelerated from the belt 13 to the sheet S, and thereby the temperature of the sheet S is prevented from decreasing.

Figure 9A:
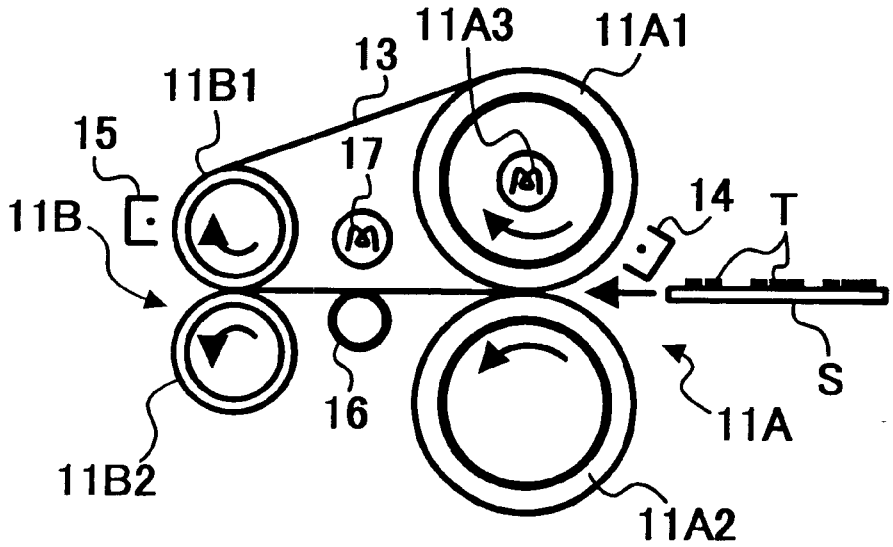
FIGS. 9A and 9B are schematic views of a construction of a fixing device according to another embodiment of the present invention.
Figure 9B:
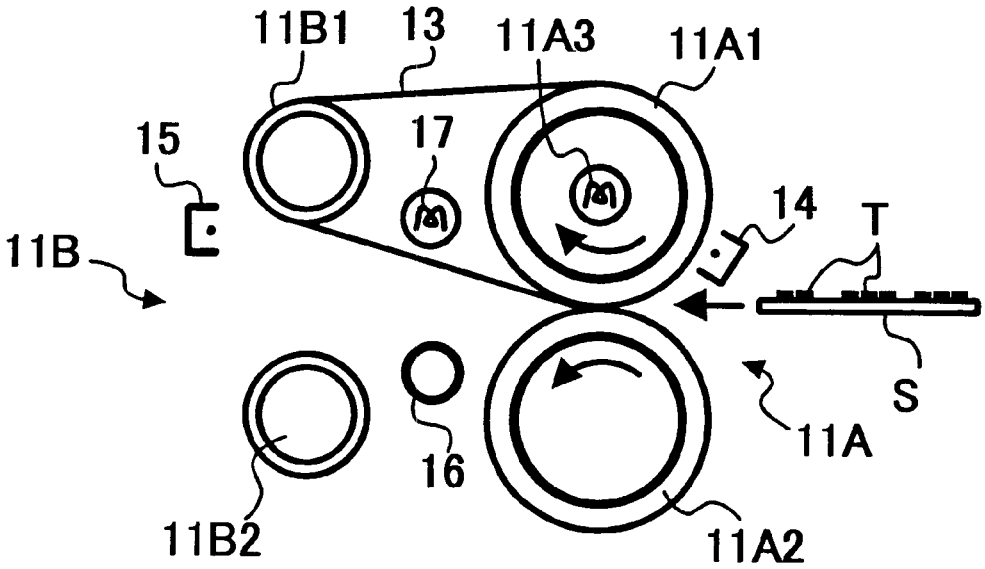

Next, a fixing device according to another embodiment of the present invention will be described referring to FIGS. 9A and 9B (hereinafter may be referred to as FIG. 9 as a whole). In the fixing device of FIG. 9, a heating device 17 is arranged at a rear surface side of the belt 13 that contacts the toner T of the fixed toner image on the sheet S so as to apply radiant heat to the rear surface of the belt 13.

In the fixing device of FIG. 9 according to another embodiment of the present invention, even if the temperature of the belt 13 decreases, the heating device 17 allows the belt 13 to be kept at a predetermined temperature. Thereby, the temperature of the sheet S is surely prevented from decreasing, so that the smoothness of the surface of the toner T of the fixed toner image on the sheet S may be easily increased in the second fixing unit 11B.

Referring to FIGS. 3 through 9, similarly as in the fixing device illustrated in FIG. 2B, FIGS. 3B through 9B respectively illustrate the fixing devices in which the smoothness of the surface of the toner T of the fixed toner image on the sheet S is not changed by the second fixing unit 11B. In this case, the sheet conveying rollers 11B1 and 11B2 of the second fixing unit 11B separate from each other.

Figure 10:
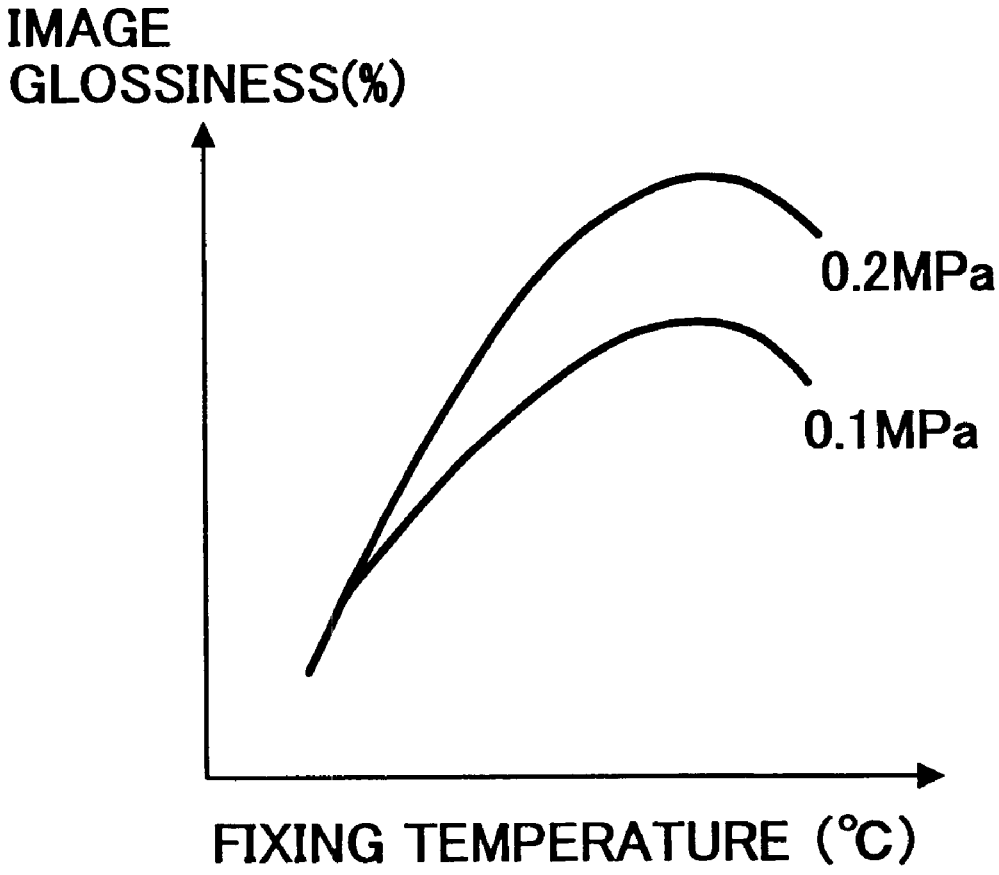
FIG. 10 is a graph showing relationships between a fixing temperature, image glossiness, and a pressure force based on experiments.

FIG. 10 is a graph showing relationships between a fixing temperature, image glossiness, and a pressure force based on experiments. As is seen from FIG. 10, as the pressure force in the second fixing unit 11B decreases, image glossiness decreases. Further, when the fixing temperature is relatively low, the image glossiness is not likely to change greatly. This shows a tendency that as the fixing temperature approaches a glass transition temperature or a temperature less than a glass transition temperature, the change of image glossiness becomes small even if the pressure force is changed.

As illustrated by the graph of FIG. 10, the degree of increase of the smoothness of the surface of the toner T of the fixed toner image on the sheet S in the second fixing unit 11B may be adjusted by changing the pressure force on the sheet S in the second fixing unit 11B.

Hereinafter is described a fixing device according to another embodiment of the present invention in which smoothness of a surface of toner of a toner image fixed onto a sheet in a first fixing unit is decreased in a second fixing unit.

Figure 11A:
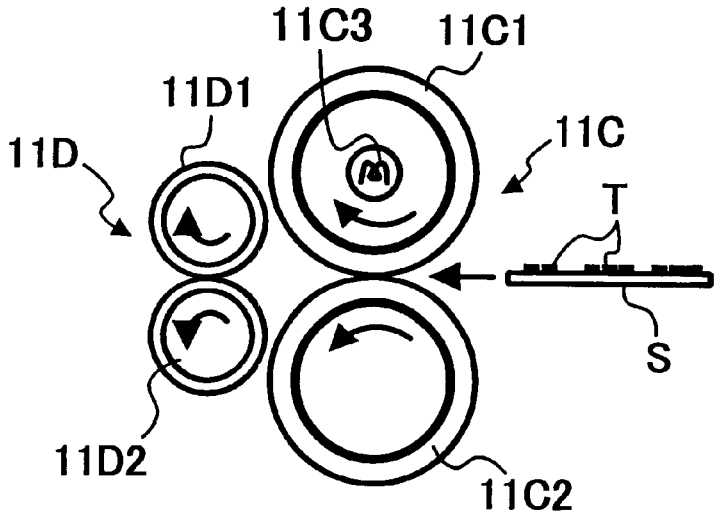
FIGS. 11A and 11B are schematic views of a construction of a fixing device according to another embodiment of the present invention.
Figure 11B:
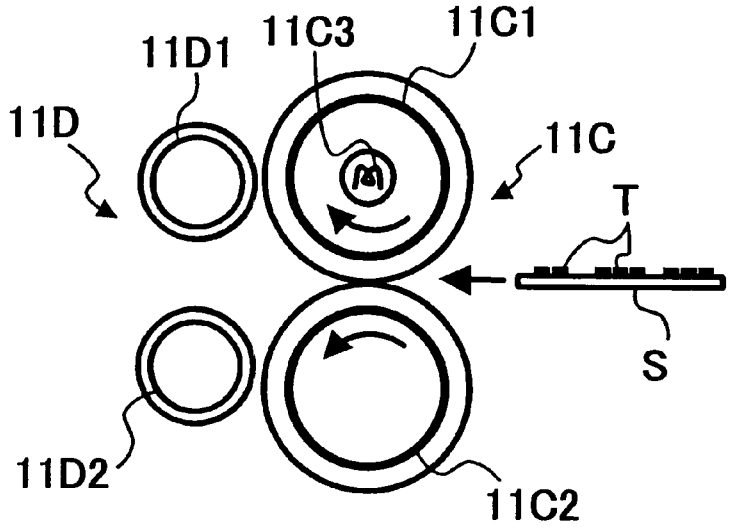

Referring to FIGS. 11A and 11B (hereinafter may be referred to as FIG. 11 as a whole), the fixing device includes a first fixing unit 11C and a second fixing unit 11D arranged along a moving direction of a sheet S carrying toner T of an unfixed toner image.

The first fixing unit 11C includes a fixing roller 11C1 and a pressure roller 11C2 which contact each other and rotate at substantially the same speed. The fixing roller 11C1 includes a heat source 11C3 such as a halogen heater and opposes the toner T on the sheet S.

The second fixing unit 11D is arranged downstream of the first fixing unit 11C in a sheet moving direction. The second fixing unit 11D includes a pair of sheet conveying rollers 11D1 and 11D2 which contact and separate from each other via a sheet conveying path. Respective constructions of the first fixing unit 11C and the second fixing unit 11D are substantially similar to those of the first fixing unit 11A and the second fixing unit 11B illustrated in FIG. 2, respectively, and their detailed descriptions are omitted here.

In the fixing device illustrated in FIG. 11, when the sheet S carrying the toner image fixed in the first fixing unit 11C passes through a nip part between the sheet conveying rollers 11D1 and 11D2 of the second fixing unit 11D, the surface of the toner T of the fixed toner image on the sheet S is roughened. That is, the smoothness of the surface of the toner T of the fixed toner image obtained in the first fixing unit 11C is decreased in the second fixing unit 11D. In this condition, the reflectivity of the surface of the toner T of the fixed toner image on the sheet S decreases, thereby decreasing glossiness of toner image.

According to the another embodiment of the present invention, the following fixing conditions are set between the first fixing unit 11C and the second fixing unit 11D.

<First Condition>

A surface temperature of the toner T of the fixed toner image on the sheet S at a nip part between the sheet conveying rollers 11D1 and 11D2 satisfies a following condition:

$$T1 \geqq Tg(^\circ C.)$$

where T1 is a surface temperature of the toner T of the fixed toner image on the sheet S at the nip part between the sheet conveying rollers 11D1 and 11D2 of the second fixing unit 11D, and Tg is a glass transition temperature.

<Second Condition>

Surface roughness (Rz) of the fixing roller 11C1 that contacts the toner T in the first fixing unit 11C and of the sheet conveying roller 11D1 that contacts the toner T in the second fixing unit 11D satisfies a following condition:

$$R2 \geqq R1(\mu m)$$

where R1 is surface roughness of the fixing roller 11C1, and R2 is surface roughness of the sheet conveying roller 11D1.

By satisfying the first and second conditions, the smoothness of the surface of the toner T of the toner image fixed onto the sheet S in the first fixing unit 11C is decreased in the second fixing unit 11D.

<Third Condition>

Surface energy (mN/m) of the fixing roller 11C1 that contacts the toner T in the first fixing unit 11C and of the sheet conveying roller 11D1 that contacts the toner T in the second fixing unit 11D satisfies a following condition:

$$E2 \geqq E1(mN/m)$$

where E1 is surface energy of the fixing roller 11C1, and E2 is surface energy of the sheet conveying roller 11D1.

By satisfying the third condition, toner offset may be likely to occur in the second fixing unit 11D, and thereby the surface of the toner T of the fixed toner image on the sheet S is roughened in the second fixing unit 11D.

In the fixing device illustrated in FIG. 11, when decreasing the smoothness of the surface of the toner T of the fixed toner image on the sheet S, the pair of sheet conveying rollers 11D1 and 11D2 contact each other via the fixed toner image on the sheet S to decrease the smoothness of the surface of the toner T of the fixed toner image on the sheet S as illustrated in FIG. 11A, and when not changing the smoothness of the surface of the toner T of the fixed toner image on the sheet S, the pair of sheet conveying rollers 11D1 and 11D2 separate from each other so that the toner T of the fixed toner image on the sheet S does not contact the sheet conveying rollers 11D1 and 11D2 as illustrated in FIG. 11B.

As described above, when decreasing the smoothness of the surface of the toner T of the fixed toner image on the sheet S, the sheet conveying rollers 11D1 and 11D2 of the second fixing unit 11D are brought in contact condition. In the second fixing unit 11D, the surface of the toner T of the fixed toner image on the sheet S, which is in a penetrating condition by heat and pressure in the first fixing unit 11C, is roughened under the influence of the surface roughness and surface energy of the sheet conveying roller 11D1.

Specifically, when the toner T of the fixed toner image on the sheet S passes through the nip part between the sheet conveying rollers 11D1 and 11D2, the surface roughness of the sheet conveying roller 11D1 is reflected in the surface roughness of the toner T of the fixed toner image on the sheet S. After the sheet S passes through the nip part between the sheet conveying rollers 11D1 and 11D2, the surface of the toner T of the fixed toner image on the sheet S is roughened, and thereby the reflectivity of the surface of the toner T of the fixed toner image on the sheet S decreases. As a result, the glossiness of toner image obtained in the first fixing unit 11C is decreased in the second fixing unit 11D.

Figure 12A:
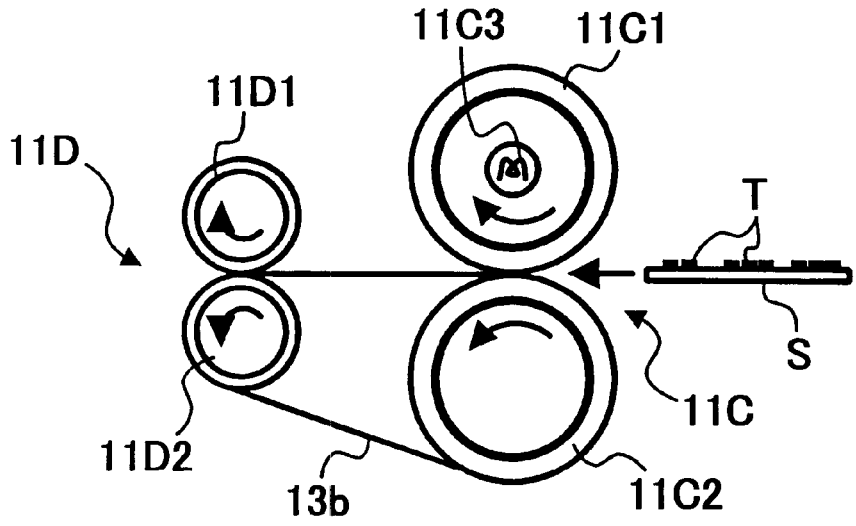
FIGS. 12A and 12B are schematic views of a construction of a fixing device according to another embodiment of the present invention.
Figure 12B:
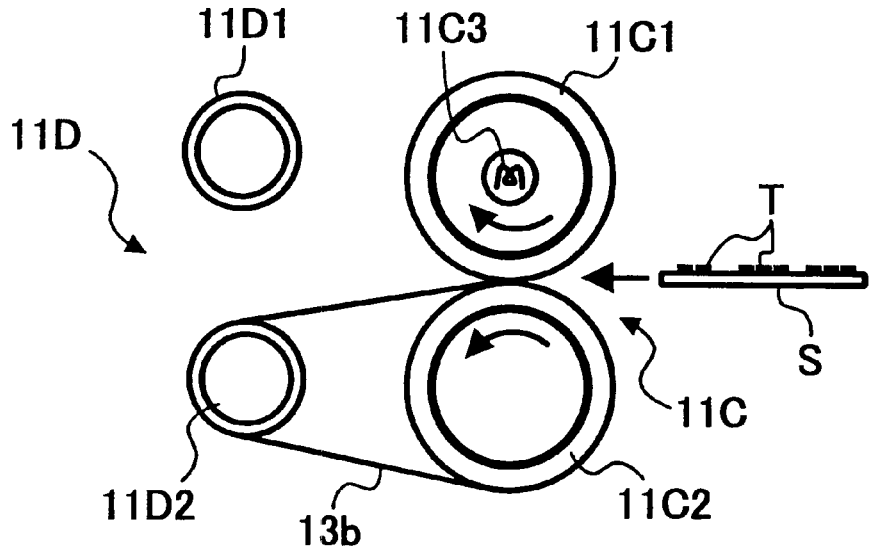

Similarly as in the fixing device illustrated in FIGS. 6A and 6B, a belt **13*b* having a thermal storage property may span the pressure roller 11C2 of the first fixing unit 11C and the sheet conveying roller 11D2 of the second fixing unit 11D as illustrated in FIGS. 12A and 12B**.

Figure 13:
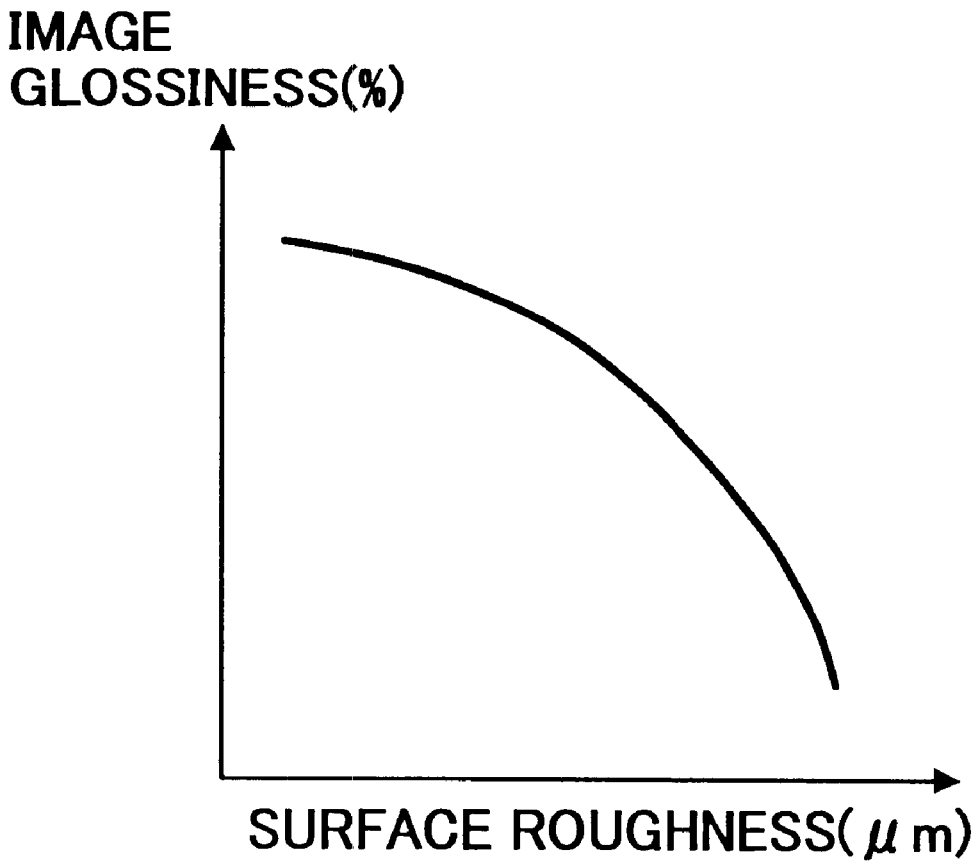
FIG. 13 is a graph showing relationships between image glossiness and surface roughness of a sheet conveying roller based on experiments.

FIG. 13 is a graph showing relationships between image glossiness and the surface roughness of the sheet conveying rollers 11B1 and 11D1 of the second fixing units 11B and 11D, respectively based on experiments. As is seen from FIG. 13, as the surface roughness of the sheet conveying rollers 11B1 and 11D1 becomes greater, image glossiness decreases.

As illustrated by the graph of FIG. 13, the smoothness of the surface of the toner T of the fixed toner image on the sheet S (i.e., image glossiness) may be adjusted by setting the surface roughness of the sheet conveying rollers 11B1 and 11D1 of the second fixing units 11B and 11D, respectively.

With respect to the setting of the surface roughness of the toner T of the fixed toner image in the first and second fixing units 11A and 11B, a toner releasing agent may be used in the fixing device. In order to avoid a toner offset condition in which fused toner attaches to a fixing member, a toner releasing agent such as silicone oil may be applied to the fixing member. In this case, occurrence of toner offset is controlled by application of toner releasing agent, thereby adjusting the surface roughness of the toner T of the fixed toner image on the sheet S.

For example, when a toner releasing agent is not applied to the fixing roller 11A1 of the first fixing unit 11A but applied to the sheet conveying roller 11B1 of the second fixing unit 11B, the toner T of the fixed toner image is not likely to be removed from the sheet S in the second fixing unit 11B. As a result, the smoothness of the toner T of the fixed toner image on the sheet S may be likely to increase in the second fixing unit 11B. Inversely, when a toner releasing agent is applied to the fixing roller 11A1 of the first fixing unit 11A but not applied to the sheet conveying roller 11B1 of the second fixing unit 11B, the toner T of the fixed toner image is likely to be removed from the sheet S in the second fixing unit 11B. As a result, the smoothness of the toner T of the fixed toner image on the sheet S may be likely to decrease in the second fixing unit 11B.

Further, in the above-described fixing device, a pressure force on the sheet S in the second fixing unit 11B may be changed to a plurality of levels. For example, when the pressure force on the sheet S in the second fixing unit 11B is slightly decreased from the pressure force set in the above-described condition, a toner image of somewhat high glossiness or medium glossiness may be obtained. When obtaining a toner image of between high and low glossiness, conditions other than a pressure force may be varied. However, from the viewpoint of the operativity and cost of an apparatus, changing the condition of the pressure force may be the easiest.

Next, a fixing device according to another embodiment will be described referring to FIGS. 14A and 14B (hereinafter may be referred to as FIG. 14 as a whole).

The fixing device of FIG. 14 includes a first fixing unit 11E and a second fixing unit 11F arranged along a moving direction of a sheet S carrying toner T of a toner image.

The first fixing unit 11E includes a fixing roller 11E1 and a pressure roller 11E2 which contact each other and rotate at substantially the same speed. The fixing roller 11E1 includes a heat source 11E3 such as a halogen heater and opposes the toner T on the sheet S.

The second fixing unit 11F is arranged downstream of the first fixing unit 11E in a sheet moving direction. The second fixing unit 11F includes a first pair of sheet conveying rollers 11F1 and 11F2 and a second pair of sheet conveying rollers 11F3 and 11F4 which contact and separate from each other via a sheet conveying path.

The construction and function of the first fixing unit 11E are substantially similar to those of the first fixing unit 11A of the fixing device of FIG. 2. The construction and function of the first pair of sheet conveying rollers 11F1 and 11F2 are substantially similar to those of the sheet conveying rollers 11B1 and 11B2 of the second fixing unit 11B of the fixing device of FIG. 2. Further, the construction and function of the second pair of sheet conveying rollers 11F3 and 11F4 are substantially similar to those of the sheet conveying rollers 11D1 and 11D2 of the second fixing unit 11D of the fixing device of FIG. 11. Therefore, their detailed descriptions are omitted here.

Figure 14A:
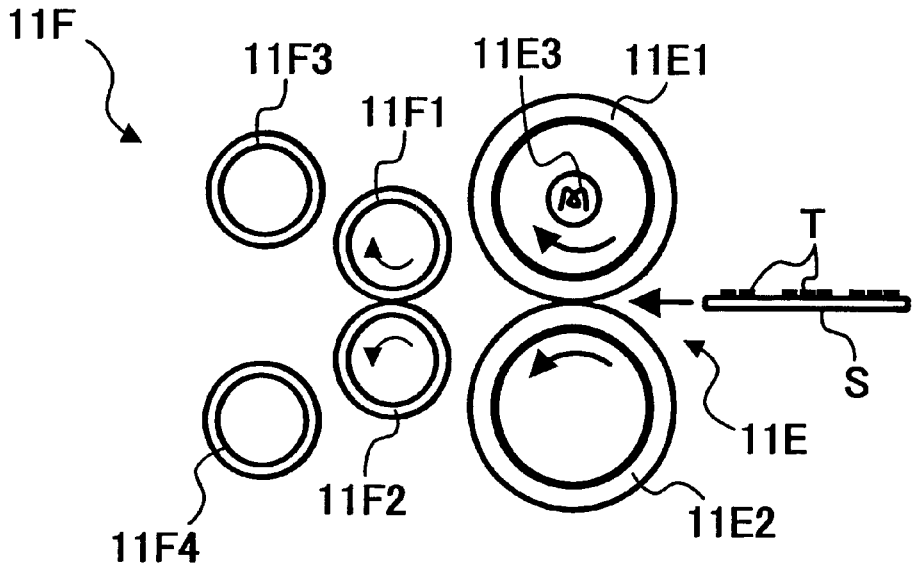
FIGS. 14A and 14B are schematic views of a construction of a fixing device according to another embodiment of the present invention.

Referring to FIG. 14A, when increasing the smoothness of the surface of the toner T of the fixed toner image on the sheet S, the first pair of sheet conveying rollers 11F1 and 11F2 contact each other via the fixed toner image on the sheet S to increase the smoothness of the surface of the toner T of the fixed toner image on the sheet S, and the second pair of sheet conveying rollers 11F3 and 11F4 separate from each other so that the toner T of the fixed toner image on the sheet S does not contact the sheet conveying rollers 11F3 and 11F4.

Figure 14B:
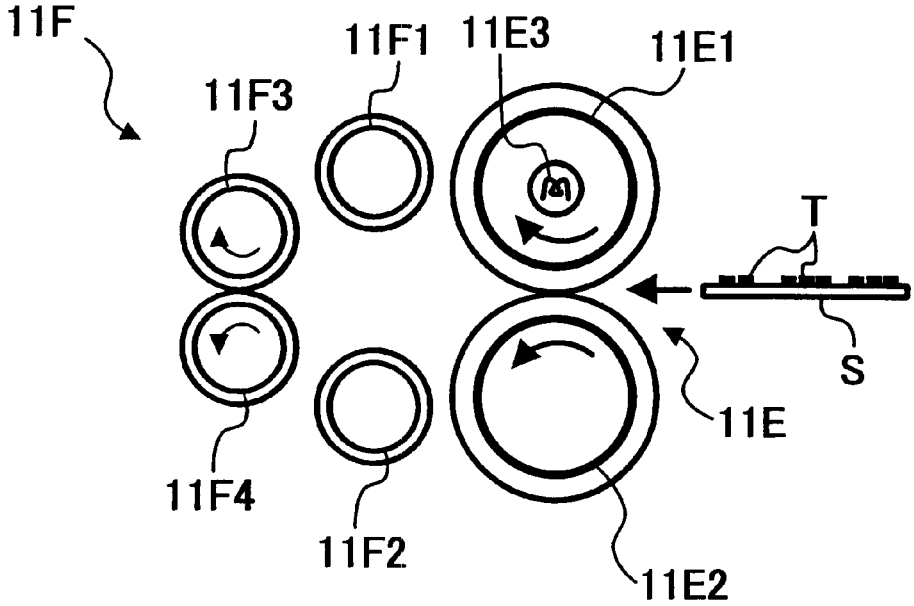
Figure 15:
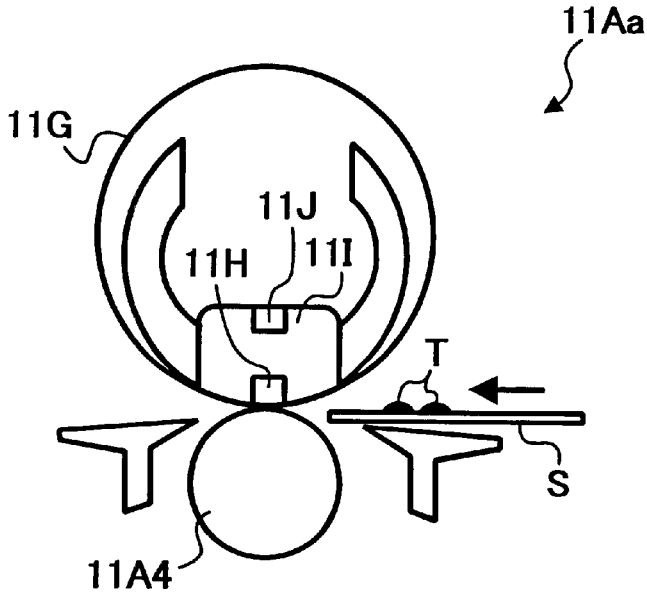
FIG. 15 is a schematic view of a construction of a fixing device according to another embodiment of the present invention.

As illustrated in FIG. 14B, when decreasing the smoothness of the surface of the toner T of the fixed toner image on the sheet S, the first pair of sheet conveying rollers 11F1 and 11F2 separate from each other so that the toner T of the fixed toner image on the sheet S does not contact the sheet conveying rollers 11F1 and 11F2, and the second pair of sheet conveying rollers 11F3 and 11F4 contact each other via the fixed toner image on the sheet S to decrease the smoothness of the surface of the toner T of the fixed toner image on the sheet S.

When not changing the smoothness of the surface of the toner T of the fixed toner image on the sheet S, the first pair of sheet conveying rollers 11F1 and 11F2 separate from each other, and the second pair of sheet conveying rollers 11F3 and 11F4 also separate from each other.

In the fixing device of FIG. 14, substantially the same fixing conditions are set between the first fixing unit 11E and the first pair of sheet conveying rollers 11F1 and 11F2 of the second fixing unit 11F as those set between the first fixing unit 11A and the second fixing unit 11B of the fixing device of FIG. 2. In addition, substantially the same fixing conditions are set between the first fixing unit 11E and the second pair of sheet conveying rollers 11F3 and 11F4 of the second fixing unit 11F as those set between the first fixing unit 11C and the second fixing unit 11D of the fixing device of FIG. 11.

Next, alternative examples of the fixing devices illustrated in FIGS. 3 through 9 using a belt will be described.

FIGS. 15 through 18 illustrate fixing devices having a construction alternative to a heating construction of the first fixing unit 11A. As an alternative to the fixing roller 11A1 of the first fixing unit 11A, a fixing unit 11Aa of FIG. 15 includes a fixing film 11G formed from a thin endless belt made of heat-resisting resin such as polyimide, and a heat source 11H such as a ceramic heater that contacts the fixing film 11G.

The heat source 11H is embedded in a supporting member 11I opposing a sheet conveying path. The supporting member 11I includes two guide portions close to the fixing film 11G at both sides of a part of the supporting member 11I where the heat source 11H is embedded. A temperature detecting member 11J is provided to the supporting member 11I to detect the temperature of the heat source 11H. Similarly as in the fixing device of FIG. 2, the temperature of the heat source 11H is controlled to be at a predetermined temperature, for example, at 170° C., based on the detect result of the temperature detecting member 11J.

In this construction, the fixing film 11G is rotated by a pressure roller 11A4 of the fixing unit 11Aa. Therefore, the fixing film 11G is made of material of relatively high coefficient of friction, and includes a toner releasing layer on a surface of the fixing film 11G on a side where the fixing film 11G contacts toner T on a sheet S.

Figure 16:
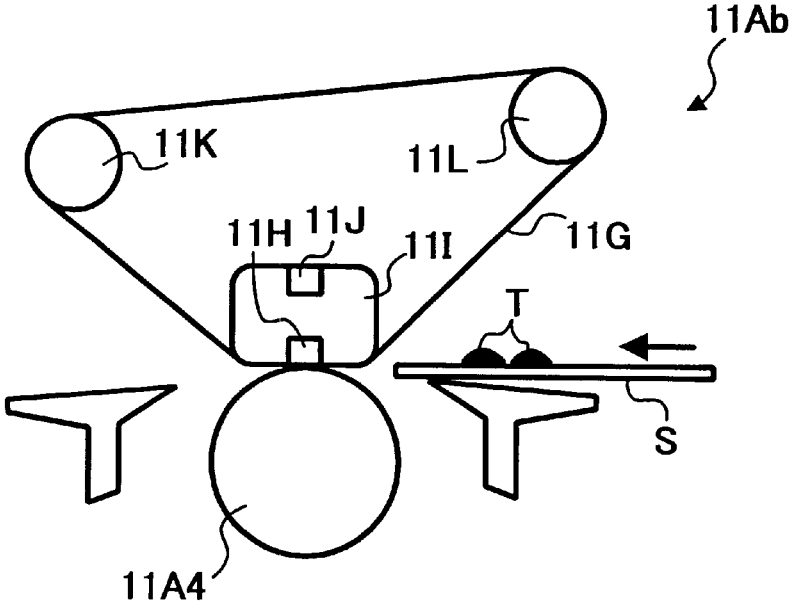
FIG. 16 is a schematic view of a construction of a fixing device according to another embodiment of the present invention.

In addition to the fixing film 11G and the supporting member 11I, a fixing unit 11Ab illustrated in FIG. 16 further includes a pair of rollers 11K and 11L around which the fixing film 11G is spanned. One of the rollers 11K and 11L is used as a drive member, thereby driving the fixing film 11G. As compared to the fixing unit 11Aa of FIG. 15, it is not necessary to control the coefficient of friction of the fixing film 11G strictly and provide guide portions in the fixing unit 11Ab of FIG. 16.

Figure 17:
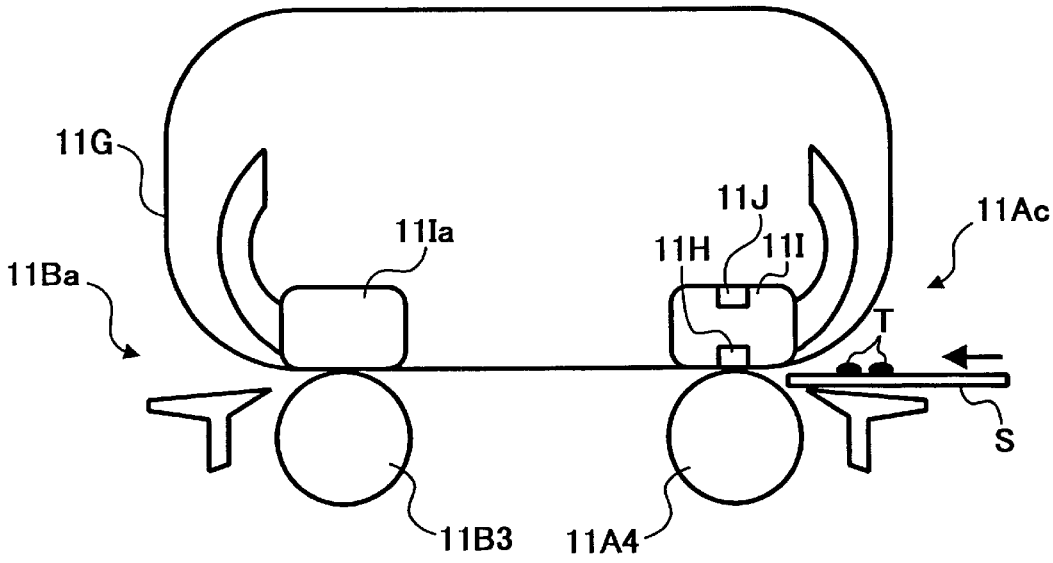
FIG. 17 is a schematic view of a construction of a fixing device of an alternative example of the fixing device of FIG. 15.

In a fixing device illustrated in FIG. 17, the fixing film 11G spans a first fixing unit 11Ac and a second fixing unit 11Ba. At the positions opposite to the pressure roller 11A4 of the first fixing unit 11Ac and to a sheet conveying roller 11B3 of the second fixing unit 11Ba, supporting members 11I and 11Ia serving as pressure guide members for the fixing film 11G are respectively arranged in symmetrical relation.

The supporting member 11I provided in the first fixing unit 11Ac includes the heat source 11H at a position opposite to the fixing film 11G, and the temperature detecting member 11J that detects the temperature of the heat source 11H. Such a heat source is not provided in the second fixing unit 11Ba. Like the fixing unit 11Aa of FIG. 15, the supporting members 11I and 11Ia respectively include guide portions for the fixing film 11G in the fixing device of FIG. 17.

Figure 18:
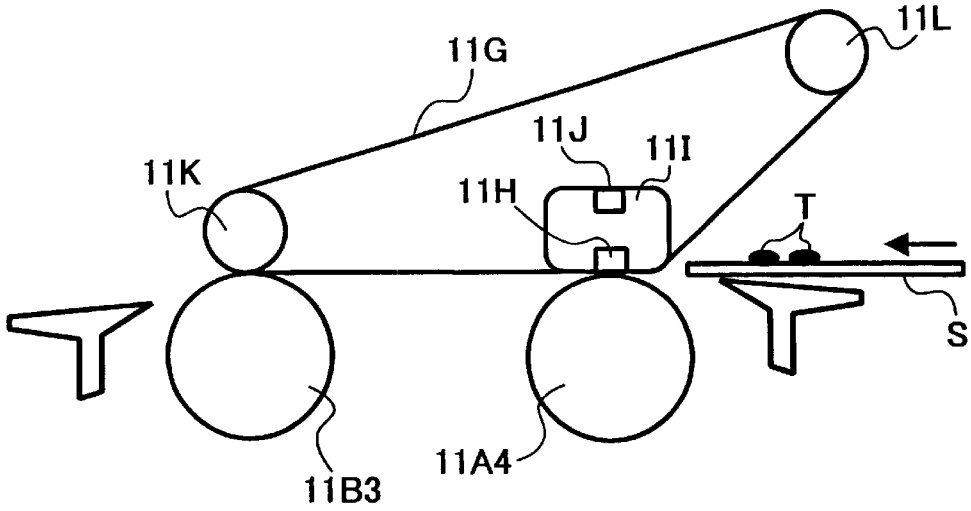
FIG. 18 is a schematic view of a construction of a fixing device of an alternative example of the fixing device of FIG. 16.

As a variation on the fixing device of FIG. 16, a fixing device of FIG. 18 includes the fixing film 11G which extends along a sheet conveying path so as to contact the sheet S. In each of the fixing devices of FIGS. 17 and 18, a part of the fixing film 11G extends in a direction substantially parallel to the sheet conveying path. The part of the fixing film 11G is positioned such that the fixing film 11G contacts the toner T of the fixed toner image on the sheet S.

In the fixing devices of FIGS. 15 through 18, the temperature of the fixing film 11G may rise quickly and the consumption of electric power may be reduced by use of the thin fixing film 11G of low heat capacity.

According to the above-described embodiments of the present invention, by use of the first and second fixing units arranged along a sheet conveying path, smoothness of a surface of toner of a fixed toner image on a sheet may be changed without necessity of changing temperature and linear velocity of a fixing member in the second fixing unit. As a result, desired image glossiness may be obtained with a simple construction of an image forming apparatus.

In the above-described embodiments, there are described two modes. In the first mode, when increasing the smoothness of the surface of the toner T of the fixed toner image on the sheet S, the sheet conveying rollers 11B1 and 11B2 of the second fixing unit 11B contact each other via the fixed toner image on the sheet S. In the second mode, when decreasing the smoothness of the surface of the toner T of the fixed toner image on the sheet S, the sheet conveying roller 11D1 and 11D2 of the second fixing unit 11D contact each other via the fixed toner image on the sheet S. When considering printing amounts of general multi-color image forming apparatuses, the first mode is more practical than the second mode.

In an image forming apparatus in which a multi-color image printing mode and a black color image printing mode for an image such as a character image and a line image are selectable, a printing amount of black color images is much greater than that of multi-color images. When printing black color images, it is preferable that black color images have low glossiness, because printed character and line images may be hard to read due to reflection if black color images have high glossiness.

Therefore, in the case of black color image printing mode which is used more frequently than the multi-color image printing mode, a black toner image on a sheet may be fixed by a first fixing unit without using a second fixing unit. In the case of multi-color image printing mode which is used less than the black color image printing mode, a multi-color toner image on a sheet may be fixed by use of both the first and second fixing units, and smoothness of a surface of toner of the multi-color toner image fixed onto the sheet in the first fixing unit is increased in the second fixing unit. As a result, the useful lifetime of the second fixing unit may be extended.

If a pressure force of the second fixing unit is switchable in several levels, at the time of the multi-color image printing mode, desired glossiness of multi-color images may be obtained by changing the pressure force of the second fixing unit in several levels. At the time of the black color image printing mode, black color images having low glossiness may be obtained by use of only the first fixing unit. In this case, user demands for printing black color images having one kind of low glossiness and multi-color images having several kinds of desired glossiness may be satisfied. As for switching between the black color image printing mode and the multi-color image printing mode, a user may switch the printing mode by manual operations or the printing mode may be switched automatically according to the judgment of a control device of an image forming apparatus.

The present invention has been described with respect to the embodiments illustrated in figure. However, the present invention is not limited to the embodiments and may be practiced otherwise.

The printer 1 in the above-described embodiments is not limited to a multi-color image forming apparatus, but may instead be a single color image forming apparatus.

Further, in the color printer 1, the order of forming images of respective colors and/or the arrangement of the developing devices for respective colors are not limited to the ones described above and can be practiced otherwise.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-023163 filed in the Japanese Patent Office on Jan. 31, 2001, and Japanese Patent Application No. 2002-001211 filed in the Japanese Patent Office on Jan. 8, 2002, and the entire contents of each of which are hereby incorporated herein by reference.

What is claimed as new and is desired to be secured by Letters Patent of the United States is:

1. A fixing device that fixes an unfixed toner image onto a moving sheet, comprising:

a first fixing unit configured to make toner of the unfixed toner image penetrate into the sheet by heat and pressure so as to be fixed onto the sheet as a fixed toner image; and a second fixing unit arranged downstream of the first fixing unit in a sheet moving direction and configured to contact and press the fixed toner image on the sheet without heating to change smoothness of a surface of the toner of the fixed toner image on the sheet, wherein the second fixing unit is arranged at a position where a temperature of the toner of the fixed toner image on the sheet is greater than a glass transition temperature.

2. The fixing device according to claim 1, wherein the second fixing unit includes a pair of sheet conveying members, and wherein when changing the smoothness of the surface of the toner of the fixed toner image on the sheet, the pair of sheet conveying members contact each other via the fixed toner image on the sheet to change the smoothness of the surface of the toner of the fixed toner image on the sheet, and when not changing the smoothness of the surface of the toner of the fixed toner image on the sheet, the pair of sheet conveying members separate from each other so that the toner of the fixed toner image on the sheet does not contact the pair of sheet conveying members.

3. The fixing device according to claim 1, wherein the second fixing unit is configured to change the smoothness of the surface of the toner of the fixed toner image on the sheet to increase.

4. The fixing device according to claim 3, wherein the first fixing unit and the second fixing unit respectively include pressure members to contact and press the fixed toner image on the sheet, and wherein pressure forces (MPa) of the pressure members of the first fixing unit and the second fixing unit satisfy a following condition:

$$P2 \geqq P1$$

where P1 is a pressure force of the pressure member of the first fixing unit, and P2 is a pressure force of the pressure member of the second fixing unit.

5. The fixing device according to claim 3, wherein the first fixing unit and the second fixing unit respectively include pressure members to contact and press the fixed toner image on the sheet, and wherein surface roughness (Rz) of the pressure members of the first fixing unit and the second fixing unit satisfies a following condition:

$$R2 \leqq R1$$

where R1 is surface roughness of the pressure member of the first fixing unit, and R2 is surface roughness of the pressure member of the second fixing unit.

6. The fixing device according to claim 3, wherein:

the first fixing unit and the second fixing unit respectively include pressure members to contact and press the fixed toner image on the sheet, and wherein surface energy (mN/m) of the pressure members of the first fixing unit and the second fixing unit satisfies a following condition:

$$E2 \leqq E1$$

where E1 is surface energy of the pressure member of the first fixing unit, and E2 is surface energy of the pressure member of the second fixing unit.

7. The fixing device according to claim 3, wherein a distance between the first fixing unit and the second fixing unit satisfies a following condition:

$$L < V(T0 - T1)$$

where T0 is a temperature of the toner of the fixed toner image on the sheet when the sheet leaves the first fixing unit, T1 is a temperature of the toner of the fixed toner image on the sheet when the sheet arrives the second fixing unit, and V (mm/s) is a moving speed of the sheet between the first and second fixing units, and wherein the temperature (T1) equals a glass transition temperature or more, and wherein (T0−T1) represents a period of time when T0 changes to T1.

8. The fixing device according to claim 1, wherein the second fixing unit is configured to change the smoothness of the surface of the toner of the fixed toner image on the sheet to decrease.

9. The fixing device according to claim 8, wherein the first fixing unit and the second fixing unit respectively include pressure members to contact and press the fixed toner image on the sheet, and wherein surface roughness (Rz) of the pressure members of the first fixing unit and the second fixing unit satisfies a following condition:

$$R2 \geqq R1$$

where R1 is surface roughness of the pressure member of the first fixing unit, and R2 is surface roughness of the pressure member of the second fixing unit.

10. The fixing device according to claim 8, wherein the first fixing unit and the second fixing unit respectively include pressure members to contact and press the fixed toner image on the sheet, and surface energy (mN/m) of the pressure members of the first fixing unit and the second fixing unit satisfies a following condition:

$$E2 \geqq E1$$

where E1 is surface energy of the pressure member of the first fixing unit, and E2 is surface energy of the pressure member of the second fixing unit.

11. The fixing device according to claim 1, wherein the second fixing unit includes a first pair of sheet conveying members configured to increase the smoothness of the surface of the toner of the fixed toner image on the sheet and a second pair of sheet conveying members configured to decrease the smoothness of the surface of the toner of the fixed toner image on the sheet, and wherein when increasing the smoothness of the surface of the toner of the fixed toner image on the sheet, the first pair of sheet conveying members contact each other and press the toner of the fixed toner image on the sheet to increase the smoothness of the surface of the toner of the fixed toner image on the sheet, and the second pair of sheet conveying members separate from each other so that the toner of the fixed toner image on the sheet does not contact the second pair of sheet conveying members, and wherein when decreasing the smoothness of the surface of the toner of the fixed toner image on the sheet, the second pair of sheet conveying members contact each other via the fixed toner image on the sheet to decrease the smoothness of the surface of the toner of the fixed toner image on the sheet, and the first pair of sheet conveying members separate from each other so that the toner of the fixed toner image on the sheet does not contact the first pair of sheet conveying members.

12. The fixing device according to claim 11, wherein:

the first fixing unit includes a pressure member to contact and press the fixed toner image on the sheet, and pressure forces (MPa) of the pressure member of the first fixing unit and one of the sheet conveying members of the first pair of the second fixing unit satisfy a following condition:

$$P2 \geqq P1$$

where P1 is a pressure force of the pressure member of the first fixing unit, and P2 is a pressure force of the one of the sheet conveying members of the first pair of the second fixing unit.

13. The fixing device according to claim 11, wherein:

the first fixing unit includes a pressure member to contact and press the fixed toner image on the sheet, and surface roughness (Rz) of the pressure member of the first fixing unit and one of the sheet conveying members of the first pair of the second fixing unit satisfies a following condition:

$$R2 \leqq R1$$

where R1 is surface roughness of the pressure member of the first fixing unit, and R2 is surface roughness of the one of the sheet conveying members of the first pair of the second fixing unit.

14. The fixing device according to claim 11, wherein:

the first fixing unit includes a pressure member to contact and press the fixed toner image on the sheet, and surface energy (mN/m) of the pressure member of the first fixing unit and one of the sheet conveying members of the first pair of the second fixing unit satisfies a following condition:

$$E2 \leqq E1$$

where E1 is surface energy of the pressure member of the first fixing unit, and E2 is surface energy of the one of the sheet conveying members of the first pair of the second fixing unit.

15. The fixing device according to claim 11, wherein a distance between the first fixing unit and a nip part between the sheet conveying members of the first pair of the second fixing unit satisfies a following condition:

$$L < V(T0 - T1)$$

where T0 is a temperature of the toner of the fixed toner image on the sheet when the sheet leaves the first fixing unit, T1 is a temperature of the toner of the fixed toner image on the sheet when the sheet arrives the nip part between the sheet conveying members of the first pair of the second fixing unit, and V (mm/s) is a moving speed of the sheet between the first fixing unit and the nip part between the sheet conveying members of the first pair of the second fixing unit, and wherein the temperature (T1) equals a glass transition temperature or more, and wherein (T0−T1) represents a period of time when T0 changes to T1.

16. The fixing device according to claim 11, wherein:

the first fixing unit includes a pressure member to contact and press the fixed toner image on the sheet, and surface roughness (Rz) of the pressure member of the first fixing unit and one of the sheet conveying members of the second pair of the second fixing unit satisfies a following condition:

$$R2 \geqq R1$$

where R1 is surface roughness of the pressure member of the first fixing unit, and R2 is surface roughness of the one of the sheet conveying members of the second pair of the second fixing unit.

17. The fixing device according to claim 11, wherein:

the first fixing unit includes a pressure member to contact and press the fixed toner image on the sheet, and surface energy (mN/m) of the pressure member of the first fixing unit and one of the sheet conveying members of the second pair of the second fixing unit satisfies a following condition:

$$E2 \geqq E1$$

where E1 is surface energy of the pressure member of the first fixing unit, and E2 is surface energy of the one of the sheet conveying members of the second pair of the second fixing unit.

18. A fixing device configured to fix an unfixed toner image onto a moving sheet, comprising:

a first fixing unit configured to make toner of the unfixed toner image penetrate into the sheet by heat and pressure so as to be fixed onto the sheet as a fixed toner image;

a second fixing unit arranged downstream of the first fixing unit in a sheet moving direction and configured to contact and press the fixed toner image on the sheet without heating to change smoothness of a surface of the toner of the fixed toner image on the sheet; and a first movable belt provided to span the first and second fixing units along the sheet moving direction and configured to move along the sheet moving direction and to contact a surface of the toner of the fixed toner image on the sheet between the first and the second fixing units, the first belt including a thermal storage property.

19. The fixing device according to claim 18, wherein the sheet is adsorbed to the first belt.

20. The fixing device according to claim 18, wherein the first belt includes a toner releasing layer on a surface thereof on a side where the belt contacts the toner of the fixed toner image on the sheet.

21. The fixing device according to claim 18, further comprising a second movable belt provided to span the first and second fixing units along the sheet moving direction and configured to move along the sheet moving direction and to contact a surface of the sheet opposite the surface of the sheet contacting the toner of the fixed toner image.

22. The fixing device according to claim 18, further comprising a heating device configured to heat the first belt and arranged on a side of a rear surface of the first belt.

23. The fixing device according to claim 21, further comprising a pressure member configured to press at least one of the first and second belts.

24. An image forming apparatus, comprising:

an image bearing member configured to bear a latent image;

a developing device configured to develop the latent image formed on the image bearing member with toner; and a fixing device configured to fix an unfixed toner image onto a moving sheet, including, a first fixing unit configured to make toner of the unfixed toner image penetrate into the sheet by heat and pressure so as to be fixed onto the sheet as a fixed toner image, and a second fixing unit arranged downstream of the first fixing unit in a sheet moving direction and configured to contact and press the fixed toner image on the sheet without heating to change smoothness of a surface of the toner of the fixed toner image on the sheet, wherein the second fixing unit is arranged at a position where a temperature of the toner of the fixed toner image on the sheet is greater than a glass transition temperature.

25. The image forming apparatus according to claim 24, wherein the second fixing unit includes a pair of sheet conveying members, and wherein when changing the smoothness of the surface of the toner of the fixed toner image on the sheet, the pair of sheet conveying members contact each other via the fixed toner image on the sheet to change the smoothness of the surface of the toner of the fixed toner image on the sheet, and when not changing the smoothness of the surface of the toner of the fixed toner image on the sheet, the pair of sheet conveying members separate from each other so that the toner of the fixed toner image on the sheet does not contact the pair of sheet conveying members.

26. The image forming apparatus according to claim 24, wherein the second fixing unit is configured to change the smoothness of the surface of the toner of the fixed toner image on the sheet to increase.

27. The image forming apparatus according to claim 26, wherein:

the first fixing unit and the second fixing unit respectively include pressure members to contact and press the fixed toner image on the sheet, and pressure forces (MPa) of the pressure members of the first fixing unit and the second fixing unit satisfy a following condition:

$$P2 \geqq P1$$

where P1 is a pressure force of the pressure member of the first fixing unit, and P2 is a pressure force of the pressure member of the second fixing unit.

28. The image forming apparatus according to claim 26, wherein:

the first fixing unit and the second fixing unit respectively include pressure members to contact and press the fixed toner image on the sheet, and surface roughness (Rz) of the pressure members of the first fixing unit and the second fixing unit satisfies a following condition:

$$R2 \leqq R1$$

where R1 is surface roughness of the pressure member of the first fixing unit, and R2 is surface roughness of the pressure member of the second fixing unit.

29. The image forming apparatus according to claim 26, wherein:

the first fixing unit and the second fixing unit respectively include pressure members to contact and press the fixed toner image on the sheet, and surface energy (mN/m) of the pressure members of the first fixing unit and the second fixing unit satisfies a following condition:

$$E2 \leqq E1$$

where E1 is surface energy of the pressure member of the first fixing unit, and E2 is surface energy of the pressure member of the second fixing unit.

30. The image forming apparatus according to claim 26, wherein a distance between the first fixing unit and the second fixing unit satisfies a following condition:

$$L < V(T0 - T1)$$

where T0 is a temperature of the toner of the fixed toner image on the sheet when the sheet leaves the first fixing unit, T1 is a temperature of the toner of the fixed toner image on the sheet when the sheet arrives the second fixing unit, and V (mm/s) is a moving speed of the sheet between the first and second fixing units, and wherein the temperature (T1) equals a glass transition temperature or more, and wherein (T0−T1) represents a period of time when T0 changes to T1.

31. The image forming apparatus according to claim 24, wherein the second fixing unit is configured to change the smoothness of the surface of the toner of the fixed toner image on the sheet to decrease.

32. The image forming apparatus according to claim 31, wherein:

the first fixing unit and the second fixing unit respectively include pressure members to contact and press the fixed toner image on the sheet, and surface roughness (Rz) of the pressure members of the first fixing unit and the second fixing unit satisfies a following condition:

$$R2 \geqq R1$$

where R1 is surface roughness of the pressure member of the first fixing unit, and R2 is surface roughness of the pressure member of the second fixing unit.

33. The image forming apparatus according to claim 31, wherein:

the first fixing unit and the second fixing unit respectively include pressure members to contact and press the fixed toner image on the sheet, and surface energy (mN/m) of the pressure members of the first fixing unit and the second fixing unit satisfies a following condition:

$$E2 \geqq E1$$

where E1 is surface energy of the pressure member of the first fixing unit, and E2 is surface energy of the pressure member of the second fixing unit.

34. The image forming apparatus according to claim 24, wherein the second fixing unit includes a first pair of sheet conveying members configured to increase the smoothness of the surface of the toner of the fixed toner image on the sheet and a second pair of sheet conveying members configured to decrease the smoothness of the surface of the toner of the fixed toner image on the sheet, and wherein when increasing the smoothness of the surface of the toner of the fixed toner image on the sheet, the first pair of sheet conveying members contact each other and press the toner of the fixed toner image on the sheet to increase the smoothness of the surface of the toner of the fixed toner image on the sheet, and the second pair of sheet conveying members separate from each other so that the toner of the fixed toner image on the sheet does not contact the second pair of sheet conveying members, and wherein when decreasing the smoothness of the surface of the toner of the fixed toner image on the sheet, the second pair of sheet conveying members contact each other via the fixed toner image on the sheet to decrease the smoothness of the surface of the toner of the fixed toner image on the sheet, and the first pair of sheet conveying members separate from each other so that the toner of the fixed toner image on the sheet does not contact the first pair of sheet conveying members.

35. The image forming apparatus according to claim 34, wherein:

the first fixing unit includes a pressure member to contact and press the fixed toner image on the sheet, and pressure forces (MPa) of the pressure member of the first fixing unit and one of the sheet conveying members of the first pair of the second fixing unit satisfy a following condition:

$$P2 \geqq P1$$

where P1 is a pressure force of the pressure member of the first fixing unit, and P2 is a pressure force of the one of the sheet conveying members of the first pair of the second fixing unit.

36. The image forming apparatus according to claim 34, wherein:

the first fixing unit includes a pressure member to contact and press the fixed toner image on the sheet, and surface roughness (Rz) of the pressure member of the first fixing unit and one of the sheet conveying members of the first pair of the second fixing unit satisfies a following condition:

$$R2 \leqq R1$$

where R1 is surface roughness of the pressure member of the first fixing unit, and R2 is surface roughness of the one of the sheet conveying members of the first pair of the second fixing unit.

37. The image forming apparatus according to claim 34, wherein:

the first fixing unit includes a pressure member to contact and press the fixed toner image on the sheet, and surface energy (mN/m) of the pressure member of the first fixing unit and one of the sheet conveying members of the first pair of the second fixing unit satisfies a following condition:

$$E2 \leqq E1$$

where E1 is surface energy of the pressure member of the first fixing unit, and E2 is surface energy of the one of the sheet conveying members of the first pair of the second fixing unit.

38. The image forming apparatus according to claim 34, wherein a distance between the first fixing unit and a nip part between the sheet conveying members of the first pair of the second fixing unit satisfies a following condition:

$$L < V(T0 - T1)$$

where T0 is a temperature of the toner of the fixed toner image on the sheet when the sheet leaves the first fixing unit, T1 is a temperature of the toner of the fixed toner image on the sheet when the sheet arrives the nip part between the sheet conveying members of the first pair of the second fixing unit, and V (mm/s) is a moving speed of the sheet between the first fixing unit and the nip part between the sheet conveying members of the first pair of the second fixing unit, and wherein the temperature (T1) equals a glass transition temperature or more, and wherein (T0−T1) represents a period of time when T0 changes to T1.

39. The image forming apparatus according to claim 34, wherein:

the first fixing unit includes a pressure member to contact and press the fixed toner image on the sheet, and surface roughness (Rz) of the pressure member of the first fixing unit and one of the sheet conveying members of the second pair of the second fixing unit satisfies a following condition:

$$R2 \geqq R1$$

where R1 is surface roughness of the pressure member of the first fixing unit, and R2 is surface roughness of the one of the sheet conveying members of the second pair of the second fixing unit.

40. The image forming apparatus according to claim 34, wherein:

the first fixing unit includes a pressure member to contact and press the fixed toner image on the sheet, and surface energy (mN/m) of the pressure member of the first fixing unit and one of the sheet conveying members of the second pair of the second fixing unit satisfies a following condition:

$$E2 \geqq E1$$

where E1 is surface energy of the pressure member of the first fixing unit, and E2 is surface energy of the one of the sheet conveying members of the second pair of the second fixing unit.

41. An image forming apparatus, comprising:

an image bearing member configured to bear a latent image;

a developing device configured to develop the latent image formed on the image bearing member with toner; and a fixing device configured to fix an unfixed toner image onto a moving sheet, including, a first fixing unit configured to make toner of the unfixed toner image penetrate into the sheet by heat and pressure so as to be fixed onto the sheet as a fixed toner image, a second fixing unit arranged downstream of the first fixing unit in a sheet moving direction and configured to contact and press the fixed toner image on the sheet without heating to change smoothness of a surface of the toner of the fixed toner image on the sheet, and a first movable belt provided to span the first and second fixing units along the sheet moving direction and configured to move along the sheet moving direction and to contact a surface of the toner of the fixed toner image on the sheet between the first and the second fixing units, the first belt including a thermal storage property.

42. The image forming apparatus according to claim 41, wherein the sheet is adsorbed to the first belt.

43. The image forming apparatus according to claim 41, wherein the first belt includes a toner releasing layer on a surface thereof on a side where the belt contacts the toner of the fixed toner image on the sheet.

44. The image forming apparatus according to claim 41, further comprising a second movable belt provided to span the first and second fixing units along the sheet moving direction and configured to move along the sheet moving direction and to contact a surface of the sheet opposite the surface of the sheet contacting the toner of the fixed toner image.

45. The image forming apparatus according to claim 41, further comprising a heating device configured to heat the first belt and arranged on a side of a rear surface of the first belt.

46. The image forming apparatus according to claim 44, further comprising a pressure member configured to press at least one of the first and second belts.

47. The image forming apparatus according to claim 24, wherein the image forming apparatus forms a single color toner image and a multi-color toner image on the sheet.

48. The image forming apparatus according to claim 41, wherein the image forming apparatus forms a single color toner image and a multi-color toner image on the sheet.

49. A fixing device that fixes an unfixed toner image onto a moving sheet, comprising:

means for fixing the unfixed toner image onto the sheet as a fixed toner image, the means for fixing by making toner of the unfixed toner image penetrate into the sheet by heat and pressure; and means for contacting and pressing the fixed toner image on the sheet, the means for contacting and pressing being arranged downstream of the means for fixing in a sheet moving direction and changing smoothness of a surface of the toner of the fixed toner image on the sheet without heating, wherein the means for contacting and pressing is arranged at a position where a temperature of the toner of the fixed toner image on the sheet is greater than a glass transition temperature.

50. The fixing device according to claim 49, wherein the means for contacting and pressing includes a pair of means for conveying the sheet, and wherein when changing the smoothness of the surface of the toner of the fixed toner image on the sheet, the pair of means for conveying the sheet contact each other via the fixed toner image on the sheet to change the smoothness of the surface of the toner of the fixed toner image on the sheet, and when not changing the smoothness of the surface of the toner of the fixed toner image on the sheet, the pair of means for conveying the sheet separate from each other so that the toner of the fixed toner image on the sheet does not contact the pair of means for conveying the sheet.

51. The fixing device according to claim 49, wherein the means for contacting and pressing includes a first pair of means for conveying the sheet configured to increase the smoothness of the surface of the toner of the fixed toner image on the sheet and a second pair of means for conveying the sheet configured to decrease the smoothness of the surface of the toner of the fixed toner image on the sheet, and wherein when increasing the smoothness of the surface of the toner of the fixed toner image on the sheet, the first pair of means for conveying the sheet contact each other and press the toner of the fixed toner image on the sheet to increase the smoothness of the surface of the toner of the fixed toner image on the sheet, and the second pair of means for conveying the sheet separate from each other so that the toner of the fixed toner image on the sheet does not contact the second pair of means for conveying the sheet, and wherein when decreasing the smoothness of the surface of the toner of the fixed toner image on the sheet, the second pair of means for conveying the sheet contact each other via the fixed toner image on the sheet to decrease the smoothness of the surface of the toner of the fixed toner image on the sheet, and the first pair of means for conveying the sheet separate from each other so that the toner of the fixed toner image on the sheet does not contact the first pair of means for conveying the sheet.

52. A fixing device that fixes an unfixed toner image onto a moving sheet, comprising:

means for fixing the unfixed toner image onto the sheet as a fixed toner image, the means for fixing making toner of the unfixed toner image penetrate into the sheet by heat and pressure;

means for contacting and pressing the fixed toner image on the sheet, the means for contacting and pressing being arranged downstream of the means for fixing in a sheet moving direction and changing the smoothness of a surface of the toner of the fixed toner image on the sheet without heating; and first means for moving along the sheet moving direction and contacting a surface of the toner of the fixed toner image on the sheet between the means for fixing and the means for contacting and pressing, the first means for moving and contacting being provided to span the means for fixing and the means for contacting and pressing along the sheet moving direction and including a thermal storage property.

53. The fixing device according to claim 52, further comprising second means for moving along the sheet moving direction and contacting a surface of the sheet opposite the surface of the sheet contacting the toner of the fixed toner image, the second means for moving and contacting being provided to span the means for fixing and the means for contacting and pressing along the sheet moving direction.

54. The fixing device according to claim 52, further comprising means for heating the first means for moving and contacting, the means for heating being arranged on a side of a rear surface of the first means for moving and contacting.

55. The fixing device according to claim 53, further comprising means for pressing at least one of the first and second means for moving and contacting.

* * * * *